US010369786B2

(12) United States Patent
Jeuté

(10) Patent No.: US 10,369,786 B2
(45) Date of Patent: Aug. 6, 2019

(54) PRINTING OF INK DROPLETS COMBINED IN A REACTION CHAMBER

(71) Applicant: Piotr Jeuté, Warsaw (PL)

(72) Inventor: Piotr Jeuté, Warsaw (PL)

( * ) Notice: Subject to any disclaimer, the term of this patent is extended or adjusted under 35 U.S.C. 154(b) by 0 days.

(21) Appl. No.: 15/552,274

(22) PCT Filed: Feb. 26, 2016

(86) PCT No.: PCT/EP2016/054090
§ 371 (c)(1),
(2) Date: Aug. 19, 2017

(87) PCT Pub. No.: WO2016/135294
PCT Pub. Date: Sep. 1, 2016

(65) Prior Publication Data

US 2018/0029361 A1 Feb. 1, 2018

(30) Foreign Application Priority Data

Feb. 26, 2015 (PL) ..... 411383
Feb. 26, 2015 (PL) ..... 411384
(Continued)

(51) Int. Cl.
*B41J 2/045* (2006.01)
*B41J 2/21* (2006.01)

(52) U.S. Cl.
CPC ..... *B41J 2/04595* (2013.01); *B41J 2/0458* (2013.01); *B41J 2/04581* (2013.01); *B41J 2/211* (2013.01)

(58) Field of Classification Search
CPC .. B41J 2/01595; B41J 2/0458; B41J 2/04581; B41J 2/211; B41J 2/04541; B41J 2/04548; B41J 2/0455; B41J 2/04573; B41J 2/04593; B41J 2/0457
See application file for complete search history.

(56) References Cited

U.S. PATENT DOCUMENTS

2004/0046825 A1 3/2004 Sugahara
2004/0217186 A1 11/2004 Sachs et al.
(Continued)

FOREIGN PATENT DOCUMENTS

DE 3416449 2/1985
DE 3501905 12/1985
(Continued)

OTHER PUBLICATIONS

WO2016135294 Search report and opinion.

*Primary Examiner* — Juanita D Jackson
(74) *Attorney, Agent, or Firm* — Soody Tronson; STLG Law Firm

(57) ABSTRACT

A drop-on-demand printing method comprising performing the following steps in a printing head: discharging a first primary drop (x21A) of a first liquid to move along a first path; discharging a second primary drop (x21B) of a second liquid to move along a second path; controlling the flight of the first primary drop (x21A) and the second primary drop (x21B) to combine the first primary drop with the second primary drop into a combined drop (x22) at a connection point (x32) within a reaction chamber within the printing head so that a chemical reaction is initiated within a controlled environment of the reaction chamber between the first liquid of the first primary drop and the second liquid of the second primary drop; and controlling the flight of the combined drop (x22) through the reaction chamber along a combined drop path such that the combined drop (x22), during movement along the combined drop path starting from the connection point is distanced from the elements of the printing head.

15 Claims, 28 Drawing Sheets

(30) Foreign Application Priority Data

| | | |
|---|---|---|
| Feb. 27, 2015 | (GB) | 1503290.7 |
| Feb. 27, 2015 | (GB) | 1503296.4 |
| Mar. 17, 2015 | (PL) | 411605 |
| Mar. 18, 2015 | (GB) | 1504539.6 |
| Jul. 21, 2015 | (EP) | 15177763 |
| Dec. 24, 2015 | (EP) | 15202656 |
| Dec. 24, 2015 | (EP) | 15202657 |
| Dec. 24, 2015 | (EP) | 15202694 |
| Dec. 24, 2015 | (EP) | 15202702 |

(56) References Cited

U.S. PATENT DOCUMENTS

| | | | | |
|---|---|---|---|---|
| 2004/0263547 | A1* | 12/2004 | Sugahara | B41J 2/04526 347/9 |
| 2007/0211098 | A1 | 9/2007 | Pechtl | |
| 2007/0236540 | A1 | 10/2007 | Hollands | |
| 2008/0018684 | A1* | 1/2008 | Nagashima | B41J 2/14233 347/10 |
| 2009/0181182 | A1* | 7/2009 | Sloan | C09D 11/101 427/508 |
| 2011/0181674 | A1 | 7/2011 | Kang et al. | |

FOREIGN PATENT DOCUMENTS

| | | |
|---|---|---|
| EP | 0 775 583 | 5/1997 |
| EP | 1024006 | 8/2000 |
| EP | 1 574 343 | 9/2005 |
| JP | S5658874 | 5/1981 |
| JP | H03 184854 | 8/1991 |
| JP | H07276629 | 10/1995 |
| JP | H07314693 | 12/1995 |
| JP | HI 1227227 | 8/1999 |
| JP | HII 227192 | 8/1999 |
| JP | 2010 105163 | 5/2010 |

* cited by examiner

PRINTING OF INK DROPLETS COMBINED IN A REACTION CHAMBER

TECHNICAL FIELD

The present invention relates to drop on demand printing heads and printing methods.

BACKGROUND

Ink jet printing is a type of printing that recreates a digital image by propelling drops of ink onto paper, plastic, or other substrates. There are two main technologies in use: continuous (CIJ) and Drop-on-demand (DOD) inkjet.

In continuous inkjet technology, a high-pressure pump directs the liquid solution of ink and fast drying solvent from a reservoir through a gunbody and a microscopic nozzle, creating a continuous stream of ink drops via the Plateau-Rayleigh instability. A piezoelectric crystal creates an acoustic wave as it vibrates within the gunbody and causes the stream of liquid to break into drops at regular intervals. The ink drops are subjected to an electrostatic field created by a charging electrode as they form; the field varies according to the degree of drop deflection desired. This results in a controlled, variable electrostatic charge on each drop. Charged drops are separated by one or more uncharged "guard drops" to minimize electrostatic repulsion between neighboring drops. The charged drops pass through an electrostatic field and are directed (deflected) by electrostatic deflection plates to print on the receptor material (substrate), or allowed to continue on undeflected to a collection gutter for re-use. The more highly charged drops are deflected to a greater degree. Only a small fraction of the drops is used to print, the majority being recycled. The ink system requires active solvent regulation to counter solvent evaporation during the time of flight (time between nozzle ejection and gutter recycling), and from the venting process whereby gas that is drawn into the gutter along with the unused drops is vented from the reservoir. Viscosity is monitored and a solvent (or solvent blend) is added to counteract solvent loss.

Drop-on-demand (DOD) may be divided into low resolution DOD printers using electro valves in order to eject comparatively big drops of inks on printed substrates, or high resolution DOD printers, may eject very small drops of ink by means of using either a thermal DOD and piezoelectric DOD method of discharging the drop.

In the thermal inkjet process, the print cartridges contain a series of tiny chambers, each containing a heater. To eject a drop from each chamber, a pulse of current is passed through the heating element causing a rapid vaporization of the ink in the chamber to form a bubble, which causes a large pressure increase, propelling a drop of ink onto the paper. The ink's surface tension, as well as the condensation and thus contraction of the vapor bubble, pulls a further charge of ink into the chamber through a narrow channel attached to an ink reservoir. The inks used are usually water-based and use either pigments or dyes as the colorant. The inks used must have a volatile component to form the vapor bubble, otherwise drop ejection cannot occur.

Piezoelectric DOD use a piezoelectric material in an ink-filled chamber behind each nozzle instead of a heating element. When a voltage is applied, the piezoelectric material changes shape, which generates a pressure pulse in the fluid forcing a drop of ink from the nozzle. A DOD process uses software that directs the heads to apply between zero to eight drops of ink per dot, only where needed.

High resolution printers, alongside the office applications, are also being used in some applications of industrial coding and marking. Thermal Ink Jet more often is used in cartridge based printers mostly for smaller imprints, for example in pharmaceutical industry. Piezoelectric printheads of companies like Spectra or Xaar have been successfully used for high resolution case coding industrial printers.

All DOD printers share one feature in common: the discharged drops of ink have longer drying time compared to CIJ technology when applied on non porous substrate. The reason being usage of fast drying solvent, which is well accepted by CIJ technology designed with fast drying solvent in mind, but which usage needs to be limited in DOD technology in general and high resolution DOD in particular. That is because fast drying inks would cause the dry back on the nozzles. In most of known applications the drying time of high resolution DOD printers' imprints on non porous substrates would be at least twice and usually well over three times as long as that of CIJ. This is a disadvantage in certain industrial coding applications, for instance very fast production lines where drying time of few seconds may expose the still wet (not dried) imprint for damage when it gets in contact with other objects.

Another disadvantage of high resolution DOD technology is limited drop energy, which requires the substrate to be guided very evenly and closely to printing nozzles. This also proves to be disadvantageous for some industrial applications. For example when coded surface is not flat, it cannot be guided very close to nozzles.

CIJ technology also proves to have inherent limitations. So far CIJ has not been successfully used for high resolution imprints due to the fact that it needs certain drop size in order to work well. The other well-known disadvantage of CIJ technology is high usage of solvent. This causes not only high costs of supplies, but also may be hazardous for operators and the environment, since most efficient solvents are poisonous, such as the widely used MEK (Methyl Ethyl Ketone).

The following documents illustrate various improvements to the ink jet printing technology.

An article "Double-shot inkjet printing of donor-acceptor-type organic charge-transfer complexes: Wet/nonwet definition and its use for contact engineering" by T. Hasegawa et al (Thin Solid Films 518 (2010) pp. 3988-3991) presents a double-shot inkjet printing (DS-IJP) technique, wherein two kinds of picoliter-scale ink drops including soluble component donor (e.g. tetrathiafulvalene, TTF) and acceptor (e.g. tetracyanoquinodimethane, TCNQ) molecules are individually deposited at an identical position on the substrate surfaces to form hardly soluble metal compound films of TTF-TCNQ. The technique utilizes the wet/nonwet surface modification to confine the intermixed drops of individually printed donor and acceptor inks in a predefined area, which results in the picoliter-scale instantaneous complex formation.

A U.S. Pat. No. 7,429,100 presents a method and a device for increasing the number of ink drops in an ink drop jet of a continuously operating inkjet printer, wherein ink drops of at least two separately produced ink drop jets are combined into one ink drop jet, so that the combined ink drop jet fully encloses the separate ink drops of the corresponding separate ink drop jets and therefore has a number of ink drops equal to the sum of the numbers of ink drops in the individual stream. The drops from the individual streams do not collide with each other and are not combined with each other, but remain separate drops in the combined drop jet.

A US patent application US20050174407 presents a method for depositing solid materials, wherein a pair of inkjet printing devices eject ink drops respectively in a direction such that they coincide during flight, forming mixed drops which continue onwards towards a substrate, wherein the mixed drops are formed outside the printing head.

A U.S. Pat. No. 8,092,003 presents systems and methods for digitally printing images onto substrates using digital inks and catalysts which initiate and/or accelerate curing of the inks on the substrates. The ink and catalyst are kept separate from each other while inside the heads of an inkjet printer and combine only after being discharged from the head, i.e. outside the head. This may cause problems in precise control of coalescence of the drops in flight outside the head and corresponding lack of precise control over drop placement on the printed object.

A Japanese patent application JP2010105163A discloses a nozzle plate that includes a plurality of nozzle holes that discharge liquids that combine in flight outside the nozzle plate.

A U.S. Pat. No. 8,092,003 presents systems and methods for digitally printing images onto substrates using digital inks and catalysts which initiate and/or accelerate curing of the inks on the substrates. The ink and catalyst are kept separate from each other while inside the heads of an inkjet printer and combine only after being discharged from the head, i.e. outside the head. This may cause problems in precise control of coalescence of the drops in flight outside the head and corresponding lack of precise control over drop placement on the printed object.

In all of the above-mentioned methods, the drops of respective primary liquids are not guided after being discharged from respective nozzles. Therefore, their path of flight on their way towards the point of connection where they start to form a mixed, combined drop, is not controlled. Such control may become necessary when mixing chemically reacting substrates in order to avoid accidental and undesired contact between substrates in the area of nozzle endings, where such too early contact might lead to residue build up of the combined substance and blocking the nozzle with time while the combined substance solidifies.

There are known various arrangements for altering the velocity of the drop exiting the printing head by using electrodes for affecting charged drops, as described e.g. in patent documents U.S. Pat. No. 3,657,599, US20110193908 or US20080074477.

The U.S. patent application US20080074477 discloses a system for controlling drop volume in continuous ink-jet printer, wherein a succession of ink drops, all ejected from a single nozzle, are projected along a longitudinal trajectory at a target substrate. A group of drops is selected from the succession in the trajectory, and this group of drops is combined by electrostatically accelerating upstream drops of the group and/or decelerating downstream drops of the group to combine into a single drop.

German patent applications DE3416449 and DE350190 present CIJ printing heads comprising drop generators which generate a continuous stream of drops. The stream of drops is generated as a result of periodic pressure disturbances in the vicinity of the nozzles that decompose the emerging inkjets to drops which have the same size and are equally spaced. The majority of drops are collected by gutters and fed back to the reservoirs supplying ink to the drop generators, as common in the CIJ technology.

A Japanese patent application JPS5658874 presents a CIJ printing head comprising nozzles generating continuous streams of drops, which are equally spaced, wherein some of the drops are collected by gutters and only some of the drops reach the surface to be printed. The paths of drops are altered by a set of electrodes such that the path of one drop is altered to cross the path of another drop.

Due to substantial structural and technological differences between the CIJ and DOD technology print heads, these print heads are not compatible with each other and individual features are not transferrable between the technologies.

A U.S. Pat. No. 8,342,669 discloses an ink set comprising at least two inks, which can be mixed at any time (as listed: before jetting, during jetting, or after jetting). A particular embodiment specifies that the inks may be mixed or combined anywhere between exiting the ink jet head and the substrate, that is, anywhere in flight. After combination of the inks between the ink jetting device and the substrate, the drops of the inks may begin to react, that is polymerization of the vinyl monomers may begin and momentum of the drops may carry the drops to a desired location on the substrate. This has, however, the disadvantage, that it is difficult to control the parameters of coalescence of the drops, as it the surrounding outside the ink jetting device is variable.

It would be desirable to control the path of flight of the primary substrate drops after they leave their respective nozzle outlets not only to ensure the appropriate coalescence, but also in order to avoid too early contact between chemically reacting substrates in the proximity of nozzle outlets. Such undesired contact might lead to the reacted substance residue build up and consequently to the nozzle clogging.

A U.S. patent application US2011/0181674 discloses an inkjet print head including a pressure chamber storing a first ink drawn in from a reservoir and transferring the first ink to a nozzle by a driving force of an actuator; and a damper disposed between the pressure chamber and the nozzle and allowing the first ink to be mixed with a second ink drawn through an ink flow path for the second ink. The disadvantage of that solution is that the mixed ink is in contact with the nozzle. This can lead to problems when the physicochemical parameters of the mixed ink do not allow for jetting of the mixed ink, or the mixed ink is not chemically stable and reactions occurring within the mixed ink cause the change of physicochemical parameters that do not allow for jetting of the mixed ink, or the reaction causes solidification of the mixed ink. In case the chemical reaction is initiated while mixing the ink components, any residue of the mixed ink which gets in contact with the nozzle may cause the residue build up, leading to clogging the nozzle during printing process.

SUMMARY

The problem associated with DOD inkjet printing is the relatively long time of curing of the ink after its deposition on the surface remains actual.

There is still a need to improve the DOD inkjet printing technology in order to shorten the time of curing of the ink after its deposition on the surface. In addition, it would be advantageous to obtain such result combined with higher drop energy and more precise drop placement in order to code different products of different substrates and shapes.

There is a need to improve the inkjet print technologies in attempt to decrease the drying (or curing) time of the imprint and to increase the energy of the printing drop being discharged from the printer. The present invention combines those two advantages and brings them to the level available so far only to CIJ printers and unavailable in the area of DOD technology in general (mainly when it comes to drying time) and high resolution DOD technology in particular, where both drying (curing) time and drop energy have been have been very much improved compared to the present state of technology. The present invention addresses also the main disadvantages of CIJ technology leading to min. 10 times reduction of solvent usage and allowing much smaller—compared to those of CIJ—drops to be discharged with higher velocity, while the resulting imprint could be consolidated on the wide variety of substrates still in a very short time and with very high adhesion.

There is presented a drop-on-demand printing method comprising performing the following steps in a printing head: discharging a first primary drop of a first liquid to move along a first path; discharging a second primary drop of a second liquid to move along a second path; controlling the flight of the first primary drop and the second primary drop to combine the first primary drop with the second primary drop into a combined drop at a connection point within a reaction chamber within the printing head so that a chemical reaction is initiated within a controlled environment of the reaction chamber between the first liquid of the first primary drop and the second liquid of the second primary drop; and controlling the flight of the combined drop through the reaction chamber along a combined drop path such that the combined drop, during movement along the combined drop path starting from the connection point is distanced from the elements of the printing head.

The method may further comprise preventing the primary drops to contact each other at the nozzle outlets by providing a separator between the plane of the nozzle outlets endings.

The method may further comprise controlling the flight of the first primary drop and the second primary drop by the separator to guide the first primary drop and the second primary drop.

The length of the side wall of the separator, from the plane of the nozzle outlet ending, can be not shorter than the diameter of the primary drop.

The method may further comprise controlling the path of flight of the first primary drop and the second primary drop at a distance not shorter than 50% of the distance between the nozzle outlet and the connection point.

The method may further comprise controlling the flight of the first primary drop and the second primary drop by an electric field.

The method may further comprise controlling at least one of the following parameters within the reaction chamber: chamber temperature, electric field, ultrasound field, UV light.

The method may further comprise heating the interior of the printing head to a temperature higher than the ambient temperature.

The method may further comprise heating the primary drops to a temperature higher than the temperature of the surface to be printed.

The flight of the first primary drop and the second primary drop can be controlled by streams of gas that alter the first path and the second path.

The streams of gas may have a temperature higher than the temperature of the generated first primary drop and the second primary drop.

The streams of gas can be continued to be generated for a certain duration after the combined drop is generated.

There is also described a drop-on-demand printing head comprising: a nozzle assembly comprising: a first nozzle connected through a first channel with a first liquid reservoir with a first liquid and having a first drop generating and propelling device for forming on demand a first primary drop of the first liquid and discharging the first primary drop to move along a first path; and a second nozzle connected through a second channel with a second liquid reservoir with a second liquid and having a second drop generating and propelling device for forming on demand a second primary drop of the second liquid and discharging the second primary drop to move along a second path. The printing head further comprises a reaction chamber; wherein the first path crosses with the second path within the reaction chamber at a connection point; means for controlling the flight of the first primary drop and the second primary drop and configured to allow the first primary drop to combine with the second primary drop at the connection point into a combined drop so that a chemical reaction is initiated within a controlled environment of the reaction chamber between the first liquid of the first primary drop and the second liquid of the second primary drop during the flow of the combined drop through the reaction chamber along a combined drop path; wherein the combined drop, during movement along the combined drop path starting from the connection point is distanced from the elements of the printing head.

There is also disclosed an inkjet printing head comprising a nozzle assembly having: at least two nozzles, each nozzle being connected through a channel with a separate liquid reservoir for forming a primary drop of liquid at the nozzle outlet; a separator having a downstream-narrowing cross-section positioned between the nozzle outlets for restricting freedom of movement of the primary drops within the printing head from the nozzle outlet in a direction towards a connection point to be combined into a combined drop at the connection point; wherein the freedom of movement of the primary drops is restricted along the length of each side wall of the separator that is not smaller than the diameter of the primary drop exiting the nozzle outlet at that side wall; wherein the nozzle outlets are configured to discharge primary drops at an angle inclined towards the longitudinal axis of the head; and a cover enclosing the nozzle outlets and the connection point.

There is also disclosed an inkjet printing head comprising a nozzle assembly comprising: a pair of nozzles, each nozzle being connected through a channel with a separate liquid reservoir for discharging in a downstream direction a primary drop of liquid at the nozzle outlet to combine at a connection point into a combined drop: a primary enclosure surrounding the nozzle outlets, and having a cross-section narrowing in the downstream direction; a source of a gas stream configured to flow in the downstream direction inside the primary enclosure; and wherein the connection point is located within the primary enclosure.

There is also disclosed a drop-on-demand inkjet printing head comprising a nozzle assembly comprising: at least two nozzles, each nozzle being connected through a channel with a separate liquid reservoir and having at its outlet a drop generating and propelling device for forming on demand a primary drop of liquid at a nozzle outlet, wherein the first nozzle is configured to discharge a first primary drop along a first path and the second nozzle is configured to discharge a second primary drop along a second path which is not aligned with the first path; a set of electrodes for altering the path of flight of the second primary drop to a path being in line with the path of flight of the first primary drop before or at a connection point to allow the first primary drop to combine with the second primary drop at the connection point into a combined drop, wherein each of the first primary drops and second primary drops are output to a surface to be printed.

In one or more embodiments, the printing head may have at least one of the features as described below.

The printing head may further comprise means for controlling the path of flight of the combined drop.

The means for controlling the flight of the first primary drop and the second primary drop can be formed by a separator having a downstream-narrowing cross-section positioned between the nozzle outlets.

The separator can be configured to guide the primary drops along its side walls and to separate nozzle outlets at the plane of their endings.

The separator can be configured to bounce the primary drops towards the connection point.

The separator may have its side walls adjacent to the nozzle outlets and configured to guide the primary drops along its side walls to combine into a combined drop at the separator tip which forms the means for restricting the freedom of combination of the primary drops.

The length of each side wall of the separator can be larger than the diameter of a primary drop exiting the nozzle outlet adjacent to that side wall.

The means for controlling the flight of the first primary drop and the second primary drop can be a set of electrodes for altering the path of flight of the second primary drop to a path being in line with the path of flight of the first primary drop before or at the connection point.

The second primary drop can be a charged drop having a non-zero electric charge or the liquid in the second reservoir connected with the second nozzle is charged.

The second nozzle may comprise charging electrodes located along the nozzle channel or at the nozzle outlet for charging the liquid flowing through the nozzle channel.

The printing head may further comprise charging electrodes for charging the second primary drop and located along the path of flight of the second primary drop before the set of electrodes for altering the path of flight of the second primary drop.

The printing head may further comprise a set of electrodes connected to a controllable DC voltage source and located downstream with respect to the connection point for deflecting and/or correcting the path of flight of the combined drop The first liquid can be an ink base and the second liquid can be a catalyst for curing the ink base.

The printing head may further comprise means for restricting the freedom of combination of the primary drops into the combined drop.

The means for restricting the freedom of combination of the primary drops into the combined drop at the connection point may have a form of a tube of a downstream-narrowing cross-section.

The tube can be located at the connection point.

The tube can be distanced downstream from the connection point.

The means for controlling the flight of the first primary drop and the second primary drop may have a form of a primary enclosure surrounding the nozzle outlets and having a cross-section narrowing in the downstream direction; and a source of a gas stream to flow downstream inside primary enclosure.

The primary enclosure may have a first section at its downstream outlet with a diameter larger than the diameter of the combined drop.

The primary enclosure may have a first section at its downstream outlet with a diameter not larger than the diameter of the combined drop.

The length of the first section of the primary enclosure can be not smaller than the diameter of the combined drop.

The printing head may further comprise a secondary enclosure surrounding the primary enclosure and connected to the source of a gas stream and comprising a first section extending downstream from the outlet of the first section of the primary enclosure and having a diameter decreasing downstream to a diameter larger than the diameter of the combined drop.

The printing head may further comprise charging electrodes at the outlet of the primary enclosure and/or at the outlet of the secondary enclosure and/or deflecting electrodes downstream behind the outlet of the secondary enclosure.

The nozzles can be inclined with respect to the longitudinal axis of the head at an angle from 5 to 75 degrees, preferably from 15 to 45 degrees.

Both nozzles can be inclined with respect to the longitudinal axis of the head at the same angle.

The nozzles can be inclined with respect to the longitudinal axis of the head at different angles.

The nozzles can be configured for discharging the primary drops of liquid in parallel to the longitudinal axis of the head.

The nozzles may have their axes parallel to each other.

The second primary drop may have a larger size than the first primary drop.

The nozzle outlets can be heated.

The printing head may comprise a plurality of nozzle assembles arranged in parallel.

The separator can be further configured to change the path of movement of the primary drops within the printing head from the nozzle outlet in a direction towards a connection point.

The separator can be configured to guide the primary drops along its side walls.

The printing head may further comprise means for restricting the freedom of combination of the primary drops into a combined drop at the connection point.

The separator can be configured to guide the primary drops within the printing head from the nozzle outlet to the connection point and to restrict the freedom of combination of the primary drops into a combined drop at the connection point.

The means for restricting the freedom of combination of the primary drops into a combined drop at the connection point may have a form of a tube of a downstream-narrowing cross-section.

The separator may have a truncated tip. The side walls of the separator can be inclined with respect to the longitudinal axis of the head at an angle from 5 to 75 degrees, and more preferably from 15 to 45 degrees, in particular 0 degrees. The side wall of the separator may have a flat, concave or convex shape to guide the primary drops along a predetermined path of flight. In case the side walls of the separator are other than flat, their fragments can be inclined with respect to the longitudinal axis of the head at an angle from 0 to 90 degrees.

Both side walls of the separator can be inclined with respect to the longitudinal axis of the head at the same angle.

The side walls of the separator can be inclined with respect to the longitudinal axis of the head at different angles.

The side walls of the separator can be inclined with respect to the longitudinal axis of the head at an angle not larger than the angle of inclination of the nozzle channels.

The side walls of the separator can be inclined with respect to the longitudinal axis of the head at an angle larger than the angle of inclination of the nozzle channels.

The separator can be heated.

The head may further comprise gas-supplying nozzles for blowing gas towards the separator tip.

The nozzles can be inclined with respect to the longitudinal axis of the head at an angle from 0 to 90 degrees, preferably from 5 to 75 degrees, more preferably from 15 to 45 degrees.

The primary drops can be ejected from the nozzles with respect to the longitudinal axis of the head at an ejection angle from 0 to 90 degrees, preferably from 5 to 75 degrees, more preferably from 15 to 45 degrees, in particular 90 degrees. The primary drops may be ejected at the ejection angle equal to the angle of inclination of nozzles with respect to the longitudinal axis of the head.

The primary drops may be ejected at the ejection angle different to the angle of inclination of nozzles with respect to the longitudinal axis of the head.

In particular, the primary drops may be ejected perpendicularly to the longitudinal axis of the head.

Both nozzles can be inclined with respect to the longitudinal axis of the head at the same angle.

The nozzles can be inclined with respect to the longitudinal axis of the head at different angles.

The second primary drop can be a charged drop having a non-zero electric charge or the liquid in the second reservoir connected with the second nozzle is charged.

The second nozzle may comprise charging electrodes located along the nozzle channel or at the nozzle outlet for charging the liquid flowing through the nozzle channel.

The printing head may further comprise charging electrodes for charging the second primary drop and located along the path of flight of the second primary drop before the set of electrodes for altering the path of flight of the second primary drop.

The printing head may further comprise another set of electrodes for altering the first path of flight of the first primary drop.

The printing head may further comprise a set of electrodes for deflecting and/or correcting the drop path of flight connected to a controllable DC voltage source and located downstream with respect to the connection point.

The printing head may further comprise a cover enclosing the nozzle outlets and the connection point.

BRIEF DESCRIPTION OF DRAWINGS

The invention is shown by means of exemplary embodiment on a drawing, in which.

DETAILED DESCRIPTION

Figure 1:
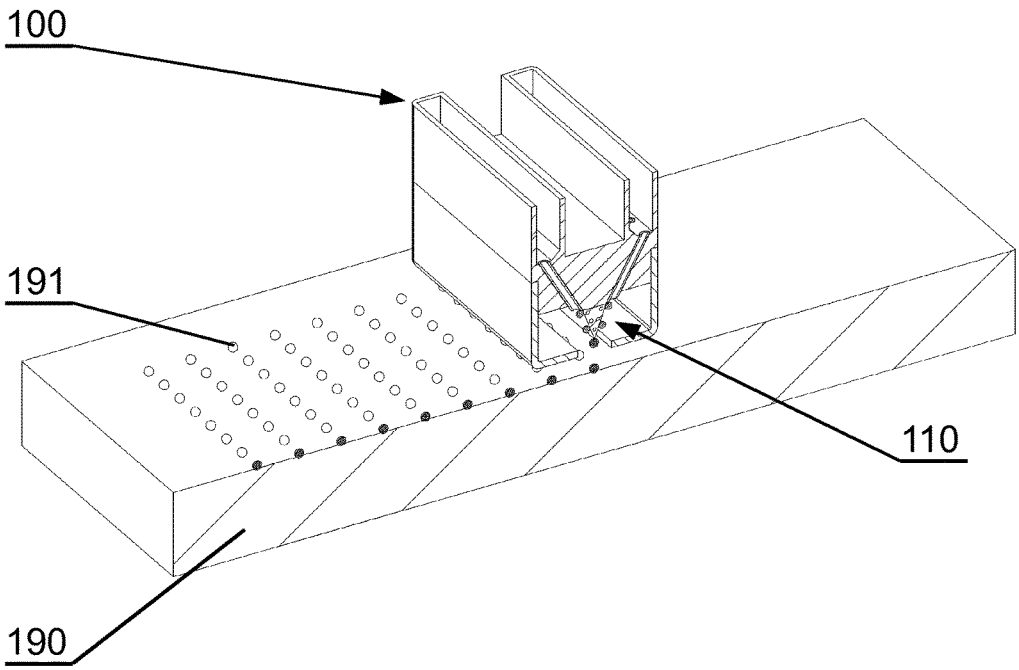
FIG. 1 shows schematically the overview of the first embodiment of the invention.

The details and features of the present invention, its nature and various advantages will become more apparent from the following detailed description of the preferred embodiments of a drop on demand printing head and printing method.

The present invention allows to shorten the time of curing of the ink after its deposition on the surface, by allowing to use fast-curing components which come into chemical reaction in a reaction chamber within the printing head, thereby increasing the efficiency and controllability of the printing process. In other words, the invention provides coalescence in controlled environment.

In the printing head according to the invention, the reaction chamber is configured such that the primary drops can combine therein into a combined drop wherein a chemical reaction is initiated, without the risk of clogging of the reaction chamber or the outlet of reaction chamber. This is achieved by means such as a separator, streams of gas or electric field that guide the primary drops away from the outlets of the nozzles before the primary drops combine with each other (e.g. to a distance of at least 50% of the diameter of the primary drop), such that the primary drops combine in flight (in the controlled and predictable environment of the reaction chamber) and immediately exit the reaction chamber.

The reaction chamber preferably has at the connection point, wherein the combined drop is formed, a size larger than the size of the expected size of the combined drop, such as to allow good coalescence of the primary drops and prevent the combined drop from touching the walls of the reaction chamber. At the connection point, there is therefore some space available for the primary drops to freely combine.

A chemical reaction is initiated between the component(s) of the first liquid forming the first primary drop and the component(s) of the second liquid forming the second primary drop when the primary drops coalesce to form the combined drop. A variety of substances may be used as components of primary drops. The following examples are to be treated as exemplary only and do not limit the scope of the invention:

- a combined drop of polyacrylate may be formed by chemical reaction between the primary drop of a monomer (for example: methyl methacrylate, ethyl methacrylate, propyl methacrylate, butyl methacrylate optionally with addition of colorant) and the second primary drop of an initiator (for example: catalyst such as trimethylolpropane, tris(1-aziridinepropionate) or azaridine, moreover UV light may be used as initiator agent)
- a combined drop of polyurethane may be formed by chemical reaction between the primary drop of a monomer (for example: 4,4'-methylenediphenyl diisocyanate (MDI) or different monomeric diisocyianates either aliphatic or cycloaliphatic) and the second primary drop of an initiator (for example: monohydric alcohol, dihydric alcohol or polyhydric alcohol such as glycerol or glycol; thiols, optionally with addition of colorant)
- a combined drop of polycarboimide may be formed by reaction between the primary drop of a monomer (for example: carbimides) and the second primary drop of an initiator (for example dicarboxylic acids such as adipic acid, optionally with addition of colorant)

In general, the first liquid may comprise a first polymer-forming system (preferably, one or more compounds such as a monomer, an oligomer (a resin), a polymer etc., or a mixture thereof) and the second liquid may comprise a second polymer-forming system (preferably, one or more compounds such as a monomer, an oligomer (a resin), a polymer, an initiator of a polymerization reaction, one or more crosslinkers ect., or a mixture thereof). The chemical reaction is preferably a polyreaction or copolyreaction, which may involve crosslinking, such as polycondensation, polyaddition, radical polymerization, ionic polymerization or coordination polymerization. In addition, the first liquid and the second liquid may comprise other substances such as solvents, dispersants etc.

By controlling the environment of the reaction chamber, it is possible to achieve controllable, full coalescence of the primary drops (which occurs only at particular conditions, dependent on the liquids, such as the speed, mass of drops, the surface tension, viscosity, angle of incidence). It is typically not possible to control these parameters at the environment outside the printing head, where the ambient temperature, pressure, humidity, wind speed may vary and have significant impact on the coalescence process (and result in deviation of the paths of flight of the drops, generation of satellite drops (which might clog the interior of the printing head), bouncing off of the primary drops, which may lead to at least loss of quality, if not to full malfunction of the printing process).

By increasing the temperature within the printing head, the surface tension and viscosity of the primary drops can be reduced.

If the coalescence process is under control, the chemical reaction may be initiated evenly within the volume of the combined drop, thereby providing prints of predictable quality. The liquids of the primary drops coalesce by mechanical manner (due to collision between the drops) and by diffusion of the components. The speed of diffusion depends on the difference of concentration of components in the individual drops and the temperature-dependent diffusion coefficient. As the temperature is increased, the diffusion coefficient increases, and the speed of diffusion of the components within the combined drop increases. Therefore, increase of temperature leads to combined drops of more even composition.

In addition, for some compositions, in particular formed of at least 3 drops, apart from the monomer(s) and initiator(s), an additional primary drop of inhibitor may be introduced, in order to slow down the chemical reaction between the monomer(s) and the initiator(s), to allow better homogenization of the composition prior to polymerization.

If the combined drop is formed such that it has a temperature higher than the temperature of the surface to be printed, the combined drop, when it hits the printed surface, undergoes rapid cooling, and its viscosity increases, therefore the drop is less prone to move away from the position at which it was deposited. This cooling process should increase the density and viscosity of the combined drop while deposited, however not to the final solidification stage, since the final solidification should result from completed chemical reaction rather than temperature change only. Moreover, as the chemical reaction (i.e. polymerization, curing (crosslinking)) is already initiated in the combined drop, the crosslinking of individual layers of printed matter is improved (which is particularly important for 3D printing).

In some embodiments, the path of flight of the first primary drop and the second primary is controlled at the whole path of flight between the nozzle outlet and the connection point. In other embodiments, the path of flight is controlled only at a portion of the distance—preferably, it should be controlled at a distance not shorter than 50% of the distance between the nozzle outlet and the connection point.

The presented solution allows to prevent remnants of combined, reacting substance to build up in the proximity of nozzle outlets by means of controlling the path of flight of primary drops after they are discharged from respective nozzle outlets.

The presented drop-on-demand printing head and method can be employed for various applications, including high-quality printing, even on non-porous substrates or surfaces with limited percolation. Very good adhesion of polymers combined with comparatively high drop energy allows for industrial printing and coding with high speeds on a wide variety of products in the last phase of their production process. The control of the gradual solidification, which includes the preliminary density increase allowing the drop to stay where applied, but at the same time allowing the chemical reaction to get completed before the final solidification, makes this technology suitable for advanced 3D printing. The crosslinking between individual layers would allow to avoid anisotropy kind of phenomena in the final 3D printed material, which would be advantageous compared to the great deal of existing 3D ink jet based technology.

First Embodiment

Figure 2A:
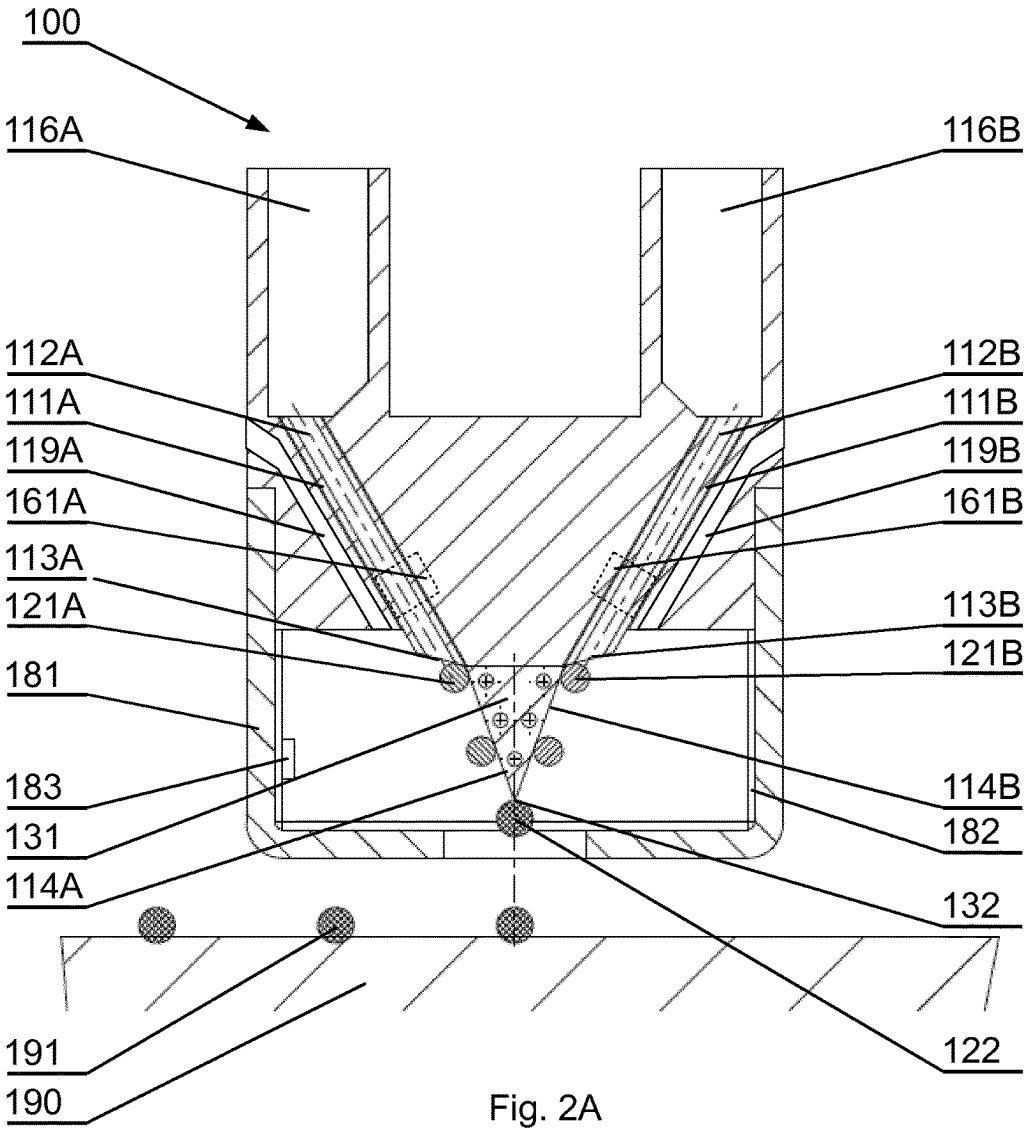
FIGS. 2A and 2B show schematically the first variant of the first embodiment.
Figure 2B:
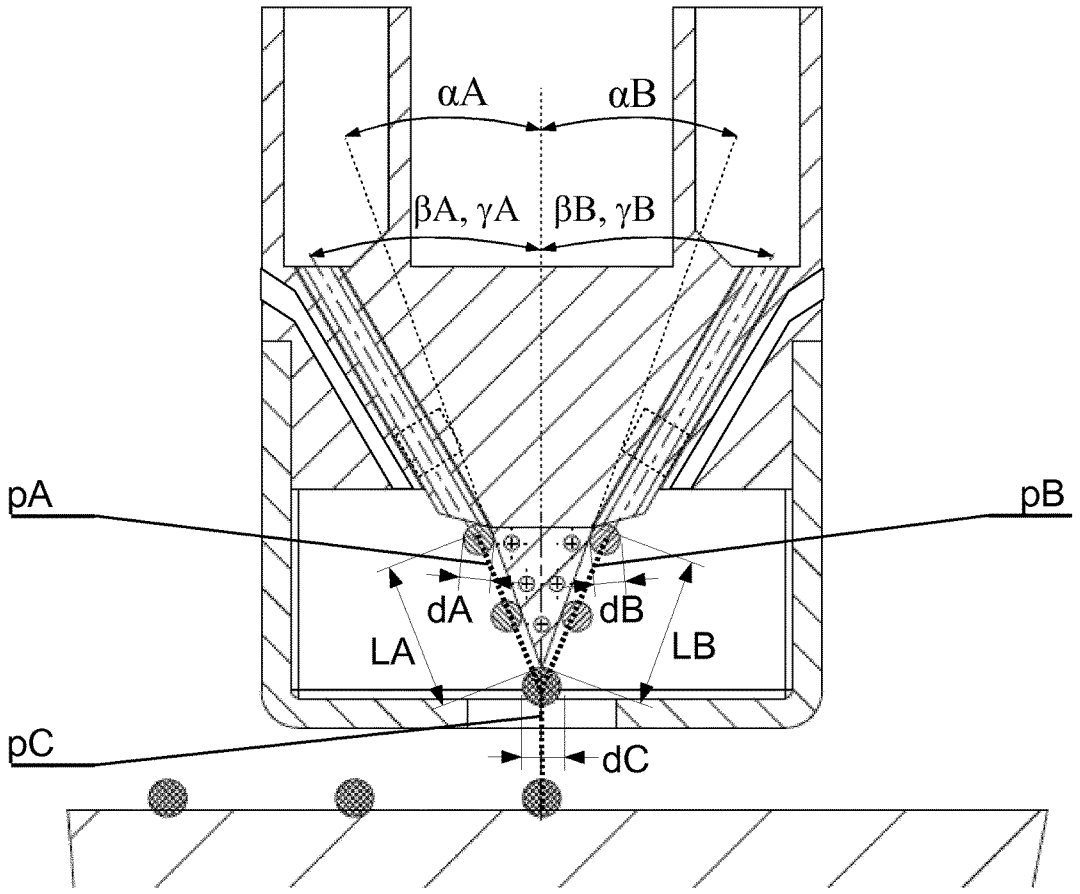

A first embodiment of the inkjet printing head 100 according to the invention is shown in an overview in FIG. 1 and in a detailed cross-sectional views in various variants on FIGS. 2A-2E. FIGS. 2A and 2B show the same cross-sectional view, but for clarity of the drawing different elements have been referenced on different figures.

The inkjet printing head 100 may comprise one or more nozzle assemblies 110, each configured to produce a combined drop 122 formed of two primary drops 121A, 121B ejected from a pair of nozzles 111A, 111B separated by a separator 131. The embodiment can be enhanced by using more than two nozzles. FIG. 1 shows a head with 8 nozzle assemblies 110 arranged in parallel to print 8-dot rows 191 on a substrate 190. It is worth noting that the printing head in alternative embodiments may comprise only a single nozzle assembly 110 or more or less than 8 nozzle assemblies, even as much as 256 nozzle assemblies or more for higher-resolution print.

Each nozzle 111A, 111B of the pair of nozzles in the nozzle assembly 110 has a channel 112A, 112B for conducting liquid from a reservoir 116A, 116B. At the nozzle outlet 113A, 113B the liquid is formed into primary drops 121A, 121B as a result of operation of drop generating and propelling devices 161A, 161B shown in FIGS. 10, 11, 12. The nozzle outlets 113A, 113B are adjacent to a separator 131 having a downstream-narrowing cross-section (preferably in a shape of a longitudinal wedge or a cone) that separates the nozzle outlets 113A, 113B (in particular, at the plane of the nozzle endings) and thus prevents the undesirable contact between primary drops 121A and 121B prior to their full discharge from their respective nozzle outlets 113A and 113B. The primary drops 121A, 121B ejected from the nozzle outlets 113A, 113B move along respectively a first path pA and a second path pB along the separator 131 towards its tip 132, where they combine to form a combined drop 122, which separates from the separator tip 132 and travels along a combined drop path pC towards the surface to be printed. Therefore, the separator 131 functions as means for controlling the flight of the first primary drop 121A and the second primary drop 121B to allow the first primary drop 121A to combine with the second primary drop 121B at the connection point 132 into the combined drop 122.

The combined drop 122, during movement along the combined drop path pC starting from the connection point is distanced from the elements of the printing head. In a theoretical example, as shown in FIG. 2B, the combined drop 122 is separated from the separator tip just after it moves away from the connection point 132. In practice, the coalescence process takes some time while the whole substance—consisting at first of two substrates which start to mix—keeps moving away from the separator towards the printed product. It means that in fact the combined drop, where the diffusion of two substrates reaches the stage allowing the chemical reaction between primary substrates to get started, is formed already after losing the contact with elements of the printing head in spite of the fact primary drops are being guided by such elements towards the connection point. There are possible various turbulences within the combined drop and the combined drop will not have a perfectly round shape from the beginning. Therefore, for the sake of clarity, it can be said that the combined drop is distanced from the elements (i.e. walls of the elements) of the printing head during movement along the combined drop path pC starting from the connection point after traveling some short distance, for example a distance of one diameter dC of the combined drop 122. The same time the combined drop path pC is distanced from the elements of the printing head by a distance larger than half the diameter of the combined drop 122. Therefore, the combined drop, after being formed, does not touch any element of the printing head, which minimizes the risk of clogging of the printing head by the material of the combined drop. Such clogging might result from residue build up of the combined, reacted substance, which might be deposited within the printing head in case of undesired contact between combined, subject to solidification reaction substance and the elements of the printing head. The printing head is therefore constructed such that the combined drop does not touch any element of the printing head other that the element that guides the primary drops towards the connection point (at which the contact with the combined drop is effected only at the very beginning of the combined drop path). Once the combined drop separates from the guiding element, it does not come into contact with the other elements of the printing head. Therefore, once the chemical reaction has been initiated in the reaction chamber and continues during the movement of the combined drop along its path, the combined drop does not contact any element of the printing head. These relationships hold for the other embodiments as well.

The liquids supplied from the two reservoirs 116A, 116B are a first liquid (preferably an ink) and a second liquid (preferably a catalyst for initiating curing of the ink). This allows initiation of a chemical reaction between the first liquid of the first primary drop 121A and the second liquid of the second primary drop 121B for curing of the ink in the combined drop 122 before it reaches the surface to be printed, so that the ink may adhere more easily to the printed surface and/or cure more quickly at the printed surface.

The chemical reaction is initiated at the connection point 132 (at which the first path crosses with the second path) within a reaction chamber, which is in this embodiment formed by the cover 181 of the print head.

For example, the ink may comprise acrylic acid ester (from 50 to 80 parts by weight), acrylic acid (from 5 to 15 parts by weight), pigment (from 3 to 40 parts by weight), surfactant (from 0 to 5 parts by weight), glycerin (from 0 to 5 parts by weight), viscosity modifier (from 0 to 5 parts by weight). The catalyst may comprise azaridine based curing agent (from 30 to 50 parts by weight), pigment (from 3 to 40 parts by weight), surfactant (from 0 to 5 parts by weight), glycerin (from 0 to 5 parts by weight), viscosity modifier (from 0 to 5 parts by weight), solvent (from 0 to 30 parts by weight). The liquids may have a viscosity from 1 to 30 mPas and surface tension from 20-50 mN/m. Other inks and catalysts known from the prior art can be used as well. Preferably, the solvent amounts to a maximum of 10%, preferably a maximum of 5% by weight of the combined drop. This allows to significantly decrease the content of the solvent in the printing process, which makes the technology according to the invention more environmentally-friendly than the current CIJ technologies, where the content of solvents usually exceeds 50% of the total mass of the drop during printing process. For this reason, the present invention is considered to be a green technology.

In the first variant of the first embodiment, as shown in FIGS. 2A and 2B, the ink drop is combined with the catalyst drop within the reaction chamber 181, in particular at the separator tip 132. However, the head construction is such that the nozzle outlets 113A, 113B are separated from each other by the separator 131 and therefore the ink and the catalyst will not mix directly at the nozzle outlets 113A, 113B, which prevents the nozzle outlets 113A, 113B from clogging. Once the drops are combined to a combined drop 122, there risk of clogging of the separator tip 132 is minimized, as the separator tip 132 has a small surface and the kinetic energy of the moving combined drop 122 is high enough to detach the combined drop 122 from the separator tip 132. The separator 131 guides the drops 121A, 121B along its surface, therefore the drops 121A, 121B are guided in a controlled and predictable manner until they meet each other. It enables much better control over the coalescence process of two primary drops as well as the control over the direction that the combined drop will follow after its discharge from the separator tip 132. It is therefore easy to control drop placement of the combined drop 122 on the surface to be printed. Even if, due to differences in size or density or kinetic energy of the primary drops 121A, 121B, the combined drop 122 would not exit the head perpendicularly (as shown in FIGS. 2A and 2B) but at an inclined angle, that angle would be relatively constant and predictable for all drops, therefore it could be taken into account during the printing process. Even relatively large-size drops—like those used for instance in low resolution valve based ink jet printers—can be combined due to the use of the separator 131 in a more predictable manner than in the prior art solutions where drops combine in-flight outside the printhead.

Therefore, the separator 131 functions as a guide for the primary drops 121A, 121B within the reaction chamber from the nozzle outlet 113A, 113B to a connection point, i.e. the separator tip 132. The separator tip 132 restricts the freedom of combination of primary drops 121A, 121B into a combined drop 122, i.e. the combined drop may form only under the separator tip 132, which impacts its further path of travel—downwards, towards the opening in the cover 181.

Figure 10:
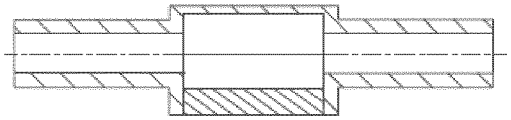
FIGS. 10, 11, 12 show schematically different devices for propelling a drop out of the nozzle.
Figure 11:
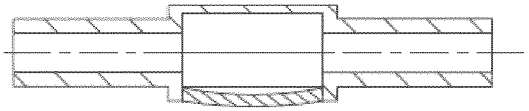
Figure 12:
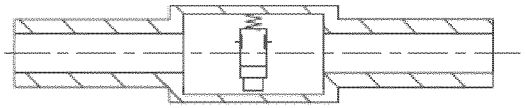

The nozzles 112A, 112B have drop generating and propelling devices 161A, 161B for ejecting the drops, which are only schematically marked in FIGS. 2A and 2B, and their schematically depicted types are shown in FIGS. 10-12. The drop generating and propelling devices may be for instance of thermal (FIG. 10), piezoelectric (FIG. 11) or valve (FIG. 12) type. In case of the valve the liquid would need to be delivered at adequate pressure.

The separator 131 as shown in FIGS. 2A and 2B is symmetrical, i.e. the inclination angles $\alpha$A, $\alpha$B of its side walls 114A, 114B are the same with respect to the axis of the head 100 or of the nozzle arrangement 110. In alternative embodiments, the separator may be asymmetric, i.e. the angles $\alpha$A, $\alpha$B may be different, depending on the parameters of liquids supplied from the nozzle outlets 113A, 113B.

The inclination angles $\alpha$A, $\alpha$B are possible from 0 to up to 90 degrees, preferably from 5 to 75 degrees, and more preferably from 15 to 45 degrees.

Preferably, the inclination angles $\beta$A, $\beta$B of the nozzle channels 112A, 112B (which are in this embodiment equal to the ejection angles $\gamma$A, $\gamma$B at which the primary drops are ejected from the nozzle channels) are not smaller (as shown in FIG. 2B) than the inclination angles $\alpha$A, $\alpha$B of the corresponding separator walls 114A, 114B, so that the ejected primary drops 121A, 121B are forced into contact with the separator walls 114A, 114B.

The separator 131 can be replaceable, which allows to assembly the head 110 with a separator 131 having parameters corresponding to the type of liquid used for printing.

The separator 131 preferably has a length LA, LB of its side wall 114A, 114B, respectively, measured from the nozzle outlet 113A, 113B (i.e. from the plane of the nozzle outlet ending) to the separator tip 132, not shorter than the diameter dA, dB of the primary drop 121A, 121B exiting the nozzle outlet 113A, 113B at that side wall 114A, 114B. This prevents the primary drops 121A, 121B from merging before they exit the nozzle outlets 113A, 113B.

The surface of the separator 131 has preferably a low friction coefficient to provide low adhesion of the drops 121A, 121B, 122, such as not to limit their movement and not introduce spin rotation of the primary drops 121A, 121B. Moreover, the side walls of the separator 131 are inclined such as to have a high wetting angle between the side walls and the primary drops, such as to decrease adhesion. In order to decrease adhesion between the separator and the drops 121A, 121B, 122, the separator and/or the nozzle outlets 113A, 113B may be heated to a temperature higher than the temperature of the environment. The liquids in the reservoirs 116A, 116B may be also preheated. Increased temperature of working fluids (i.e. ink and catalyst) may also lead to improved coalescence process of primary drops and preferably increase adhesion and decrease the curing time of the combined drop 122 when applied on the substrate.

As shown in FIG. 1, the separator 131 may be common for a plurality of nozzle assemblies 110. In alternative embodiments, each nozzle assembly 110 may have its own separator 131 and/or cover 181 or a sub-group of nozzle assemblies 110 may have its own common separator 131 and/or cover 181.

The printing head may further comprise a cover 181 which protects the head components, in particular the separator tip 132 and the nozzle outlets 113A, 113B, from the environment, for example prevents them from touching by the user or the printed substrate.

Moreover, the cover 181 may comprise heating elements 182 for heating the volume within the reaction chamber 181, i.e. the volume surrounding of the nozzle outlets 113A, 113B and the separator 131 to a predetermined temperature, for example from 40° C. to 60° C. (other temperatures are possible as well, depending on the parameters of the drops), such as to provide stable conditions for combining of the drops. A temperature sensor 183 may be positioned within the cover 181 to sense the temperature.

Moreover, the printing head 110 may comprise gas-supplying nozzles 119A, 119B for blowing gas (such as air or nitrogen), preferably heated to a temperature higher than the ambient temperature or higher than the temperature of the liquids in the first and second reservoir (i.e. to a temperature higher than the temperature of the generated first and second drop), towards the separator tip 132, in order to decrease the curing time, increase the dynamics of movement of the drops and to blow away any residuals that could be formed at the nozzles outlets 113A, 113B separator tip 132. In this embodiment, as well as in the other embodiments described below, the streams of gas can be generated in an intermittent manner, for at least the time of flight of the combined drop through the printing head from the connection point in the reaction chamber to the outlet of the printing head, which allows to control by means of the streams of gas the flight of the combined drop. Moreover, the streams of gas can be generated in an intermittent manner, for at least the time since the primary drops exit the nozzle outlets till the combined drop exits the outlet of the printing head, which allows to control by means of the streams of gas the flight of the primary drops and of the combined drop. Moreover, the streams of gas may continue to blow after the combined drop exits the printing head, for example even for a few seconds after the printing is finished (i.e. after the last drop is generated), in order to clean the components of the printing head from any residue of the first liquid, second liquid or their combination. The stream of gas may be also generated and delivered in a continuous manner.

Therefore, that embodiment can be used in drop on demand printing method to discharge the first primary drop 121A of the first liquid to move along the first path and to discharge the second primary drop 121B of the second liquid to move along the second path; and to control, by means of the separator, the flight of the first primary drop 121A and the second primary drop 121B to combine the first primary drop 121A with the second primary drop 121B at the connection point 132 within the reaction chamber 181 within the printing head so that a chemical reaction is initiated within a controlled environment of the reaction chamber 181 between the first liquid of the first primary drop 121A and the second liquid of the second primary drop 121B.

Figure 2C:
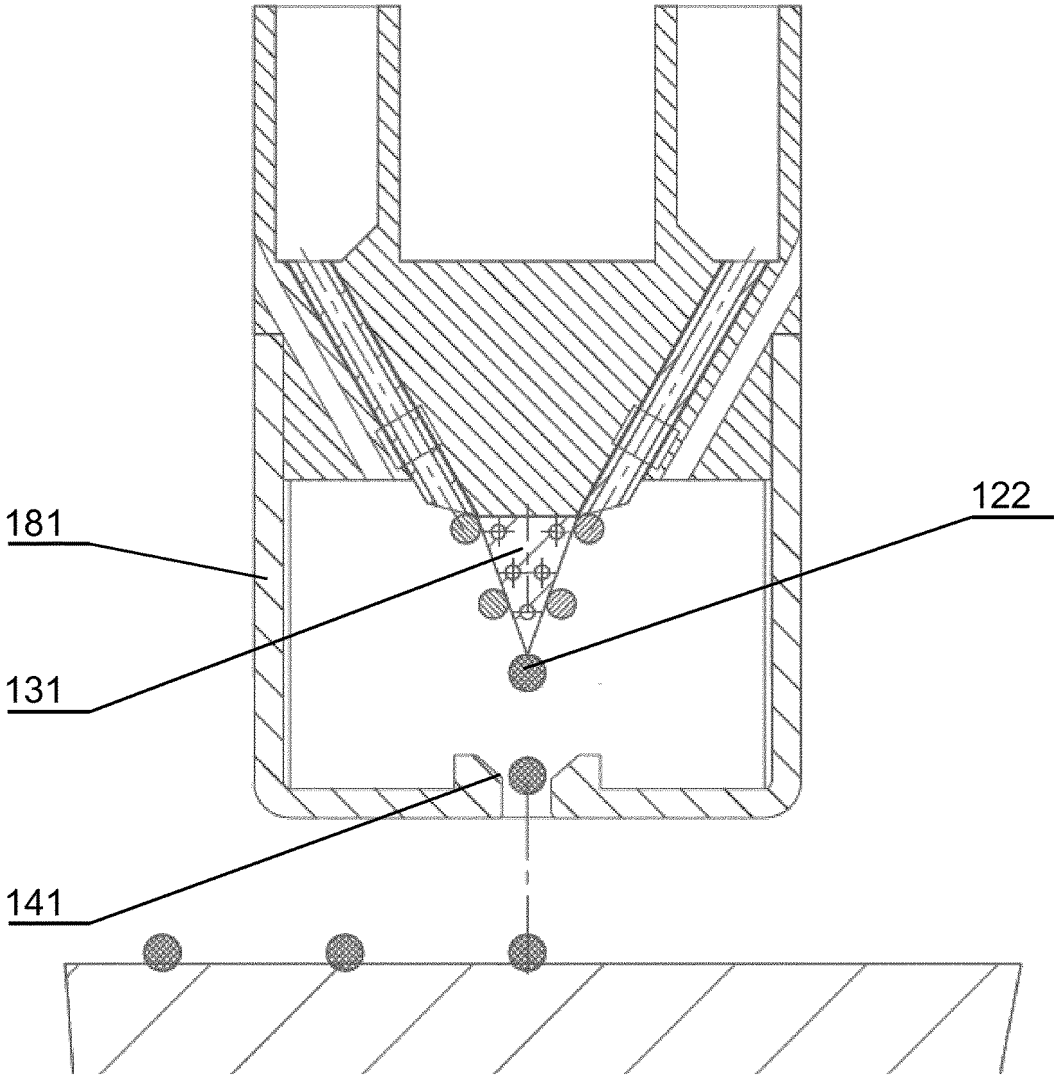
FIG. 2C shows schematically the second variant of the first embodiment.

The second variant of the first embodiment, as shown in FIG. 2C, differs from the first variant of FIG. 2A in that a tube 141 of a narrowing cross-section is formed at the outlet opening of the cover 181, i.e. at the outlet of the reaction chamber. The downstream outlet of the tube 141 has preferably a cross-section of a diameter at least slightly larger (e.g. at least 110% or at least 150% or at least two times larger) than the desired diameter of the combined drop 122.

Figure 2D:
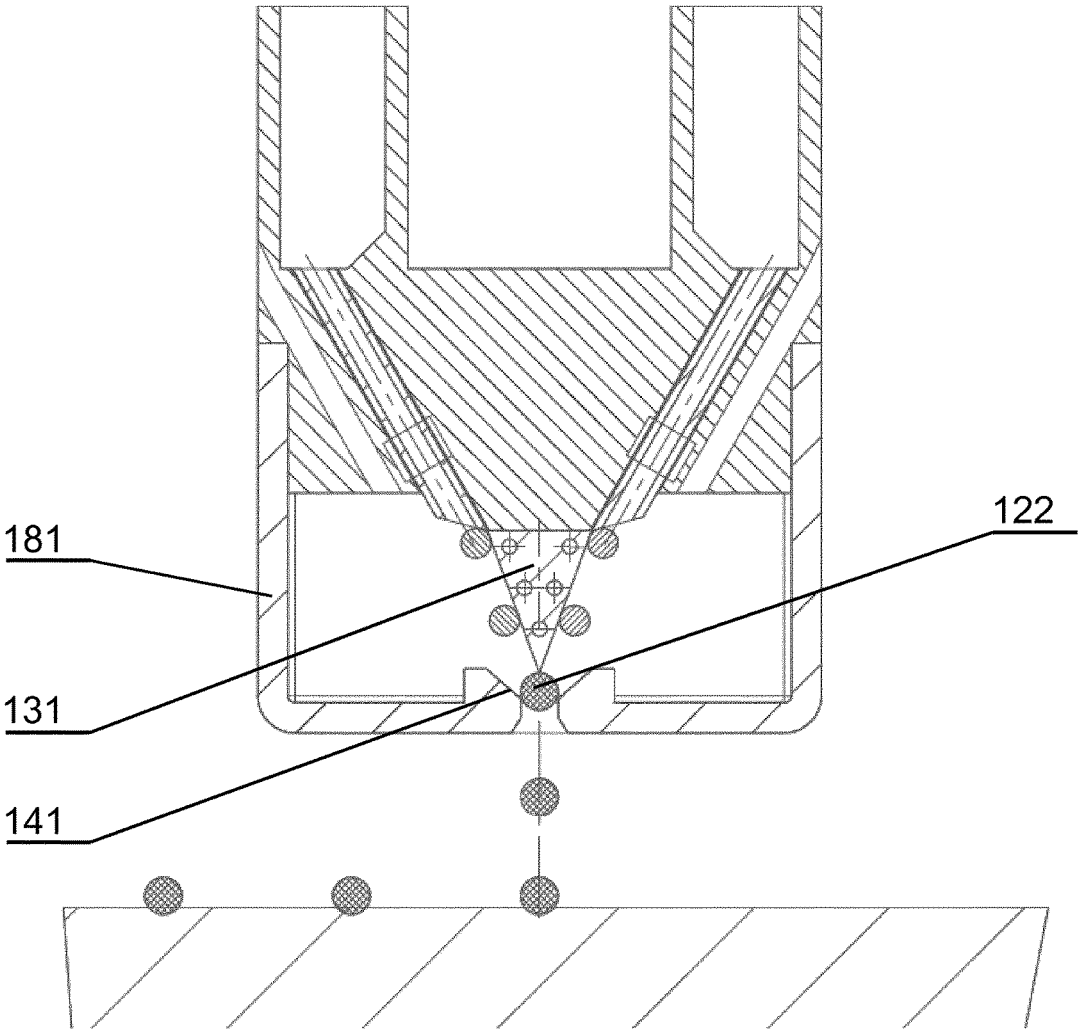
FIG. 2D shows schematically the third variant of the first embodiment.

The third variant of the first embodiment, as shown in FIG. 2D, differs from the variant of FIG. 2C in that the tube 141 is located at the connection point, such that it's both the tube 141 and the tip of the separator 131 that jointly function as means for restricting the freedom of combination of the primary drops into a combined drop at the connection point. Therefore, the tube 141 functions both as the restricting means and a combined drop nozzle.

Figure 2E:
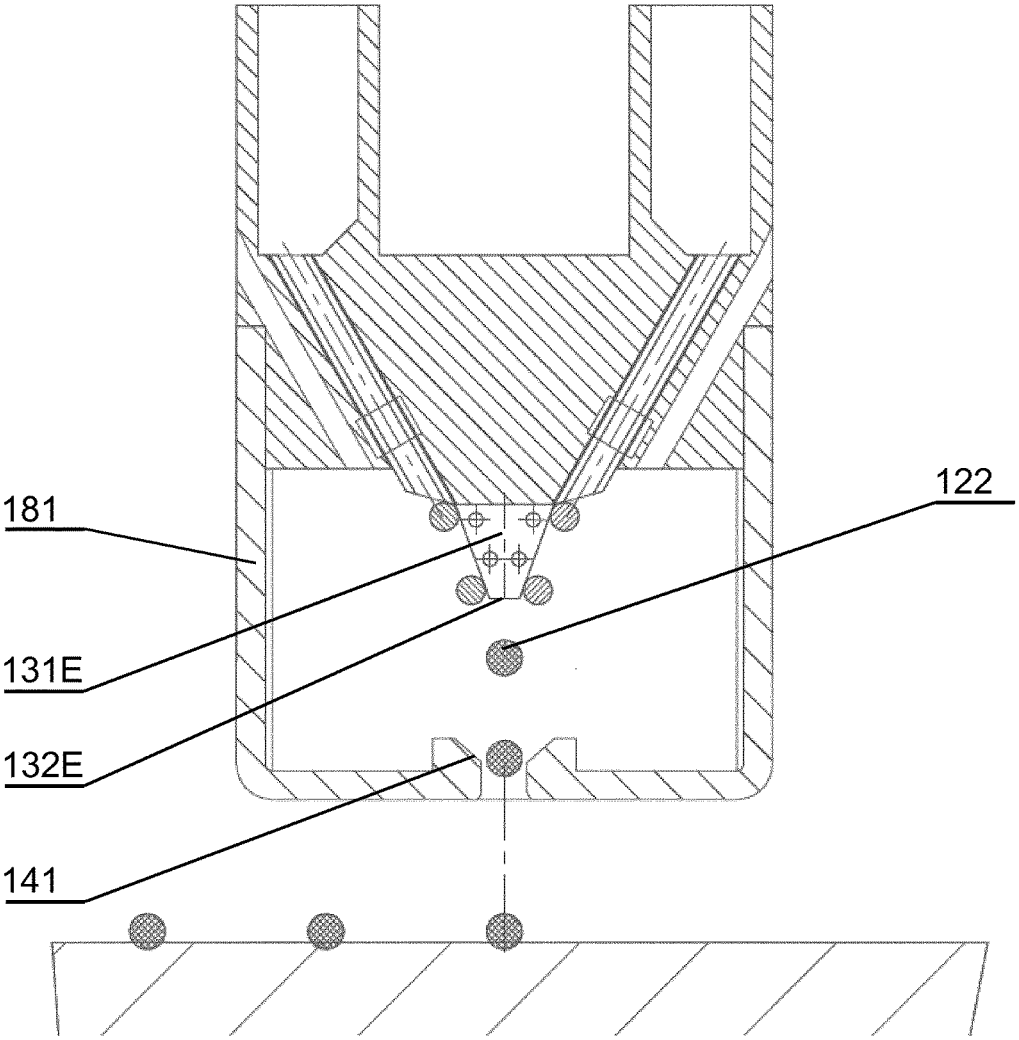
FIG. 2E shows schematically the fourth variant of the first embodiment.

The fourth variant of the first embodiment, as shown in FIG. 2E, differs from the first variang of FIG. 2A-2B and the second variant of FIG. 2C in that the separator 131E has a truncated tip 132E, such that the primary drops are only guided from the nozzle outlets towards the connection point, but are no longer in contact with the separator 131E at the connection point. In that case, the coalescence process occurs unrestricted at the connection point, but is at least partially controlled in that the primary drops have been guided by the separator side walls, so that their direction is more precisely set as compared to drops which would have been discharged directly from the nozzle outlets and not guided on their way towards the connection point. Even a very short form of separator with the length of the side walls being not shorter than the diameter of the primary drop, has a very important function apart from primary drop guidance. This function is preventing the undesired accidental contact between primary substrates in the proximity of nozzle outlets, which might result in the residue of the combined, subject to solidification reaction build up leading to the nozzle clogging. Such undesired contact might result for example from outside vibrations during printing process, which may happen especially in industrial printing applications.

Second Embodiment

Figure 3:
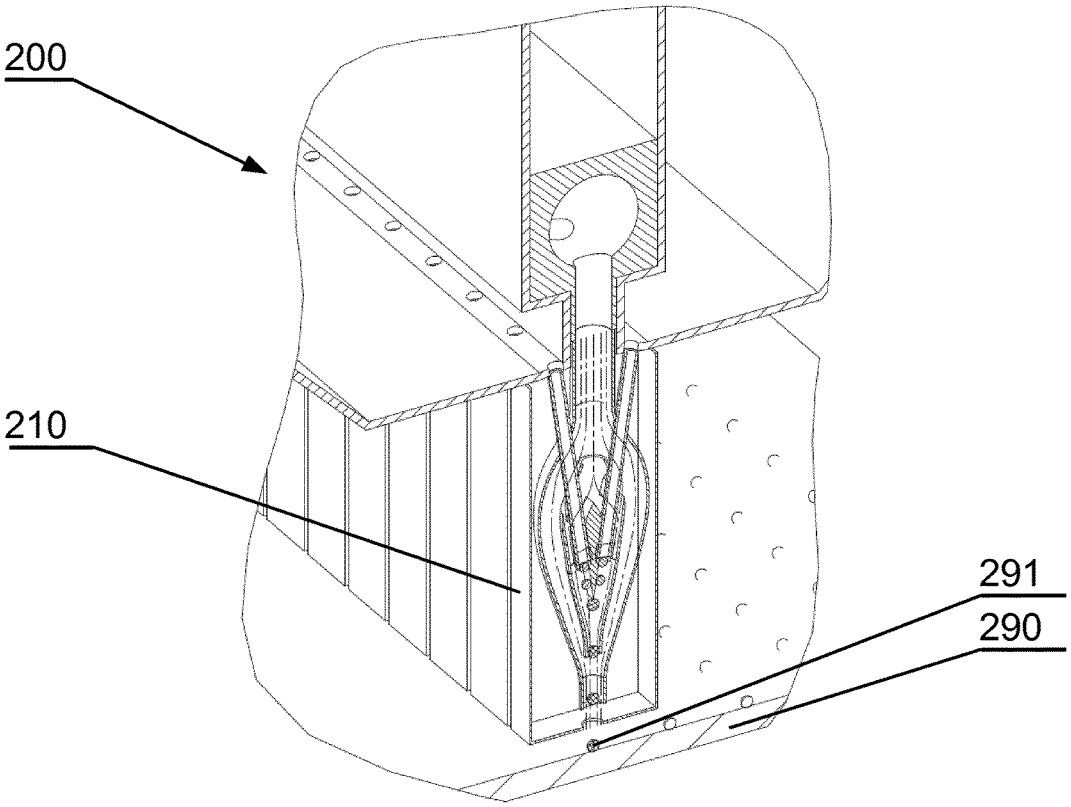
FIGS. 3, 4A, 4B, 5 and 6 show schematically the first variant of the second embodiment of the invention.
Figure 4A:
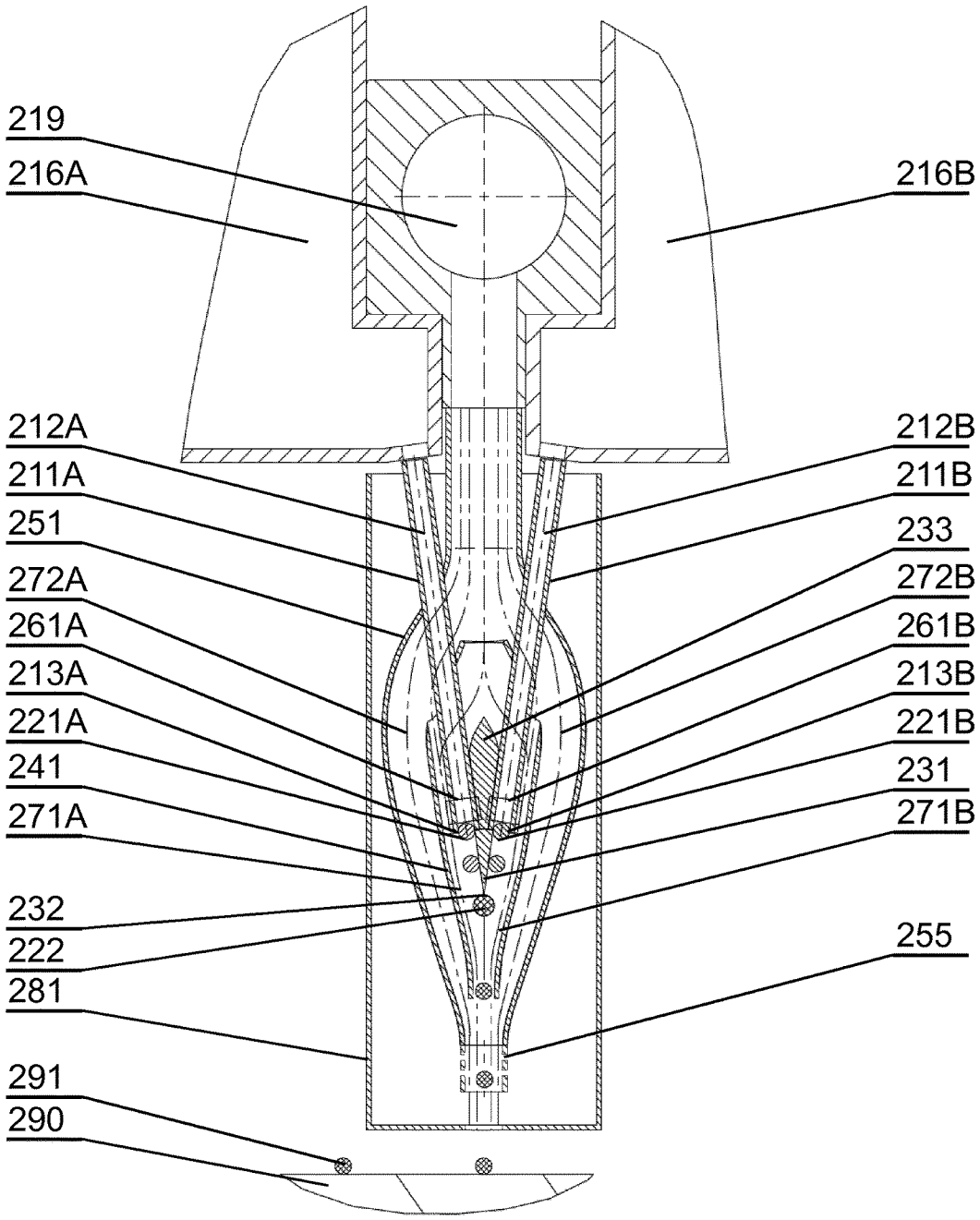
Figure 4B:
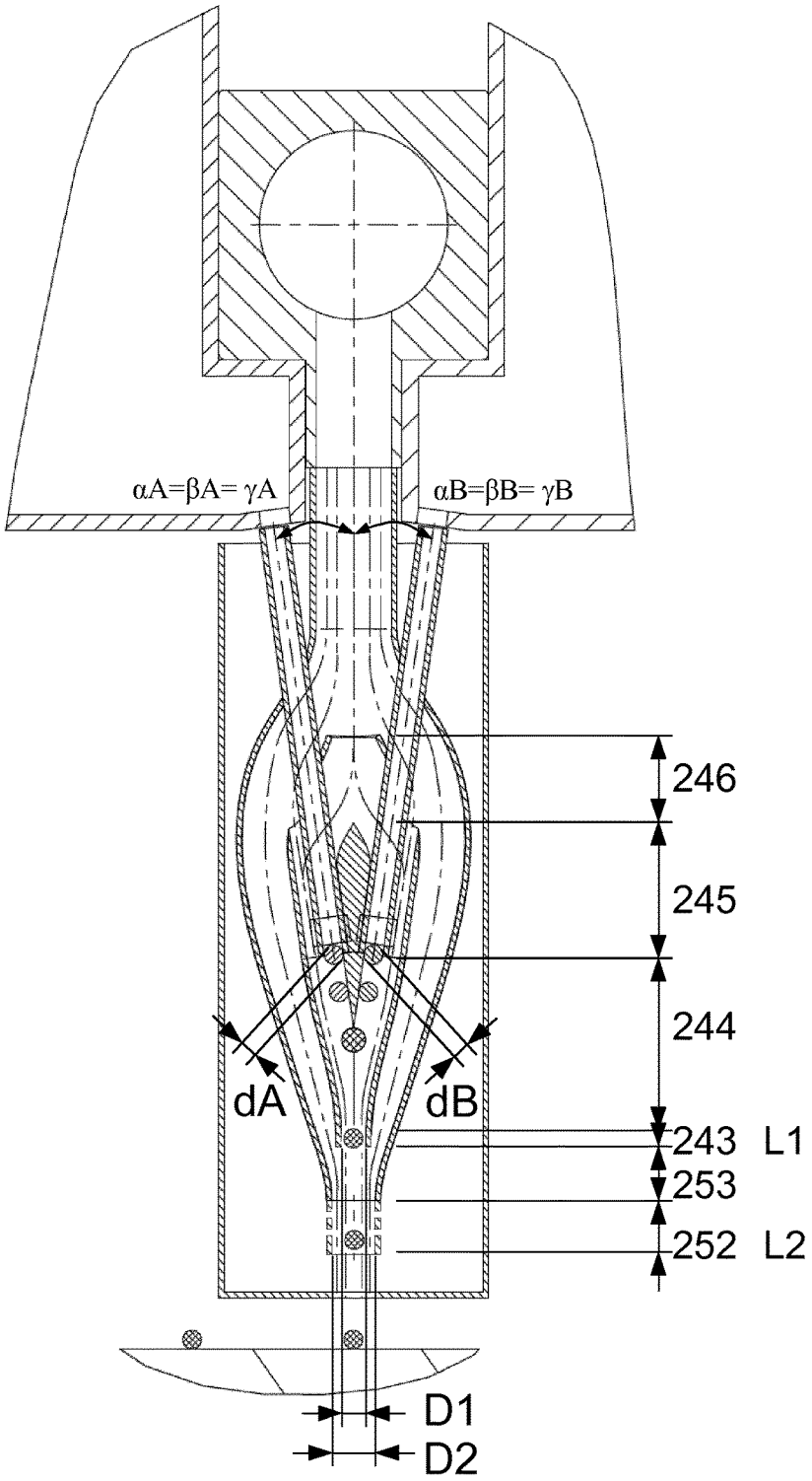
Figure 5:
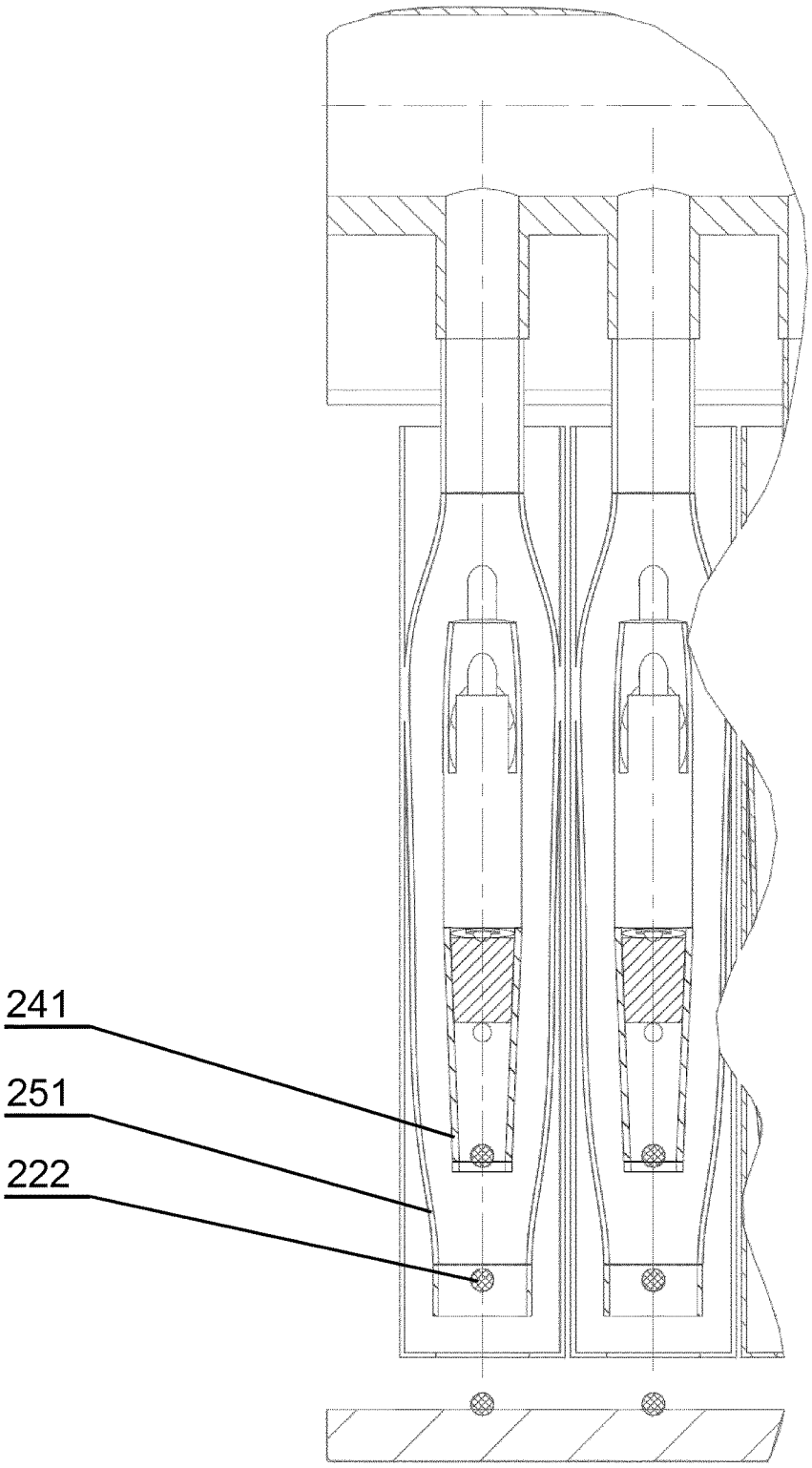
Figure 6:
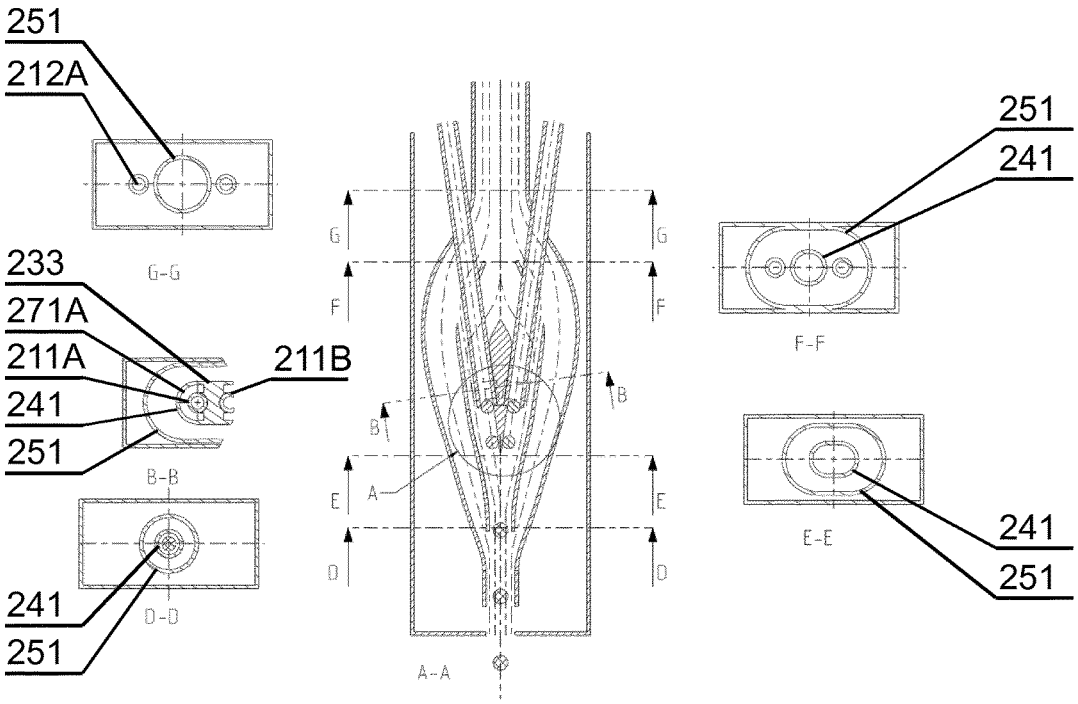

A first variant of the second embodiment of the inkjet printing head 200 according to the invention is shown in an overview in FIG. 3. FIGS. 4A and 4B show the same longitudinal cross-sectional view, but for clarity of the drawing different elements have been referenced on different figures. FIG. 5 shows a longitudinal cross-sectional view along a section parallel to that in FIGS. 4A and 4B. FIG. 6 shows various transverse cross-sectional views.

The inkjet printing head 200 may comprise one or more nozzle assemblies 210, each configured to produce a combined drop 222 formed of two primary drops 221A, 221B ejected from a pair of nozzles 211A, 211B. FIG. 3 shows a head with a plurality of nozzle assemblies 210 arranged in parallel to print multi-dot rows 291 on a substrate 290. It is worth noting that the printing head may comprise only a single nozzle assembly 210 or even as much as 256 nozzle assemblies or more.

Each nozzle 211A, 211B of the pair of nozzles in the nozzle assembly 210 has a channel 212A, 212B for conducting liquid from a reservoir 216A, 216B. At the nozzle outlet 213A, 213B the liquid forms a primary drop 221A, 221B. At the nozzle outlet 213A, 213B the liquid is formed into primary drops 221A, 221B as a result of operation of drop generating and propelling devices 261A, 261B shown on FIGS. 10, 11, 12. The nozzle outlets 213A, 213B are adjacent to a conical-shaped separator 231 that separates the nozzle outlets 213A, 213B. The primary drops ejected from the nozzle outlets 213A, 213B move along respectively a first path and a second path along the separator 231 towards its tip 232, where they combine to form a combined drop 222, which separates from the separator tip 232 and travels towards the surface to be printed.

The primary drops 221A, 221B are guided along the surface of the separator 231 by streams 271A, 271B of gas (such as air or nitrogen, provided from a pressurized gas input 219, having a pressure of preferably 5 bar) inside a primary enclosure 241. The shape of the primary enclosure 241 in its upper part helps to direct the stream of gas alongside the nozzles 211A, 211B and guides drops from the outlets 213A, 213B of the nozzles 211A, 211B towards the connection point at the separator tip 232, at which they join to form the combined drop 222. Therefore, for all embodiments, the connection point can be considered as any point on the path of the primary drops, starting from the point at which the coalescence starts, via points at which the coalescence develops, towards a point at which the coalescence ends, i.e. the combined drop is formed to its final shape. It is important that the separator guides the drops towards that connection point. Preferably, at the connection point, the freedom of combination of the primary drops into a combined drop is restricted, so as to aid development of the combined drop.

The nozzles 212A, 212B have drop generating and propelling devices 261A, 261B for ejecting the drops, which are only schematically marked in FIGS. 4A and 4B, and their schematically depicted types are shown in FIGS. 10-12. The drop generating and propelling devices may be for instance of thermal (FIG. 10), piezoelectric (FIG. 11) or valve (FIG. 12) type. In case of the valve the liquid would need to be delivered at adequate pressure.

The primary enclosure 241 has sections of different shapes. The first section 243, which is located furthest downstream (i.e. towards the direction of flow of the combined drop 222) has preferably a constant, round cross-section of a diameter D1 at least slightly larger (e.g. at least 110% or at least 150% or at least two times larger) than the desired diameter dC of the combined drop 222. Preferably, the cross-section of the first section 243, is not smaller than at least 110% of the cross-section of the combined drop 222, such that the combined drop 222 does not touch the walls of the primary enclosure 241. Therefore, at the outlet of the primary enclosure 241 at the downstream end of the first section 243, there is formed a kind of combined drop nozzle, through which the drop is pushed thanks to its kinetic energy enhanced by moving gas. This improves precision of its movement directly forward, which facilitates precise drop placement, which in turn improves the print quality. The second section 244 (of primary enclosure 241) is located between the first section 243 and the nozzle outlets 213A, 213B and has a diameter which increases upstream (i.e. opposite the direction of drops flow), such that its upstream diameter encompasses the nozzle outlets 213A, 213B and leaves some space for gas 271A, 271B to flow between the enclosure walls and nozzle outlets 213A, 213B. At the same time the cross section of the primary enclosure 241 changes upstream from round to elliptical one, since the width of the cross section increases more with length upstream, than its depth (cf. cross section E-E on FIG. 6). The internal walls of the second section 244 converge downstream, therefore the flowing gas stream 271A, 271B forms an outer gas sleeve that urges the drops 221A, 221B, 222 towards the centre of the enclosure 241.

The primary enclosure 241 may further comprise a third section 245 located upstream the second section, which has internal walls in parallel to the external walls of the nozzles 211A, 211B. As more clearly visible in the cross-section B-B (shown for the left part only) of FIG. 6, the nozzle 211A is surrounded by the primary enclosure 241 and separated from the nozzle 211B by the blocking element 233, such that the stream of gas 271A flows only at the outer periphery of the nozzles 211A, 211B but not between the nozzles 211A, 211B wherein it is blocked by the blocking element 233, which then forms the separator 231.

The stream of gas 271A, 271B that is guided by this section is in parallel to the direction of ejecting of the primary drops 221A, 221B from the nozzle outlets 213A, 213B. Parallel direction of the flowing gas stabilized prior to its contact with primary drops improves the control over the path of drops flow starting from the nozzle outlets 213A, 213B, since from the very moment of discharge, their flow is supported in terms of energy and direction by the flowing gas. It is worth noticing that the shape of the primary enclosure 241 is preferably designed in such a way to enhance the appropriate velocity of gas flowing thorough respective sections, i.e. 245, 244, 243. The velocity of the flowing gas is preferably higher than drop velocity precisely at the nozzle outlets area, which is close to the end of section 245, preferably at least not lower than the drop velocity in the area of the section 244 and higher again in the nozzle 243, where the flow will be forced to be of higher velocity again due to the smaller cross section surface of the outflow channel, i.e. the nozzle 243. Such design would leave some room for gas pressure momentary compensating adjustments while for the short instant the gas flow through the nozzle 243 would slow down by passing combined drop 222. This momentary pressure increase in the section 244 would preferably add more kinetic energy for the drop 222 on leaving the nozzle 243.

In any case in the second section 244 of the primary enclosure 241 the gas stream 271A, 271B is preferably configured to flow with a linear velocity not smaller than the velocity of the primary ink drops 221A, 221B ejected from the nozzle outlets 213A, 213B. The temperature of the gas may be increased to allow better coalescence and mixing of the primary drops 221A, 221B by decreasing the surface tension and viscosity of the ink and the curing agent (polymerization initiator). The geometry of the first section 243 relative to the second section 244—especially the decrease of cross section surface of section 243 vs. section 244—is designed such that the gas increases its velocity, preferably from 5 to 20 times, thus increasing the kinetic energy of the coalesced combined drop 222 and stabilizing the flow of the combined drop 222.

Therefore, the separator 231 and the streams 271A, 271B of gas function as means for controlling the flight of the first primary drop 221A and the second primary drop 221B to allow the first primary drop 221A to combine with the second primary drop 221B at the connection point 232 into the combined drop 222.

The liquids supplied from the two reservoirs 216A, 216B are a first liquid (preferably an ink) and a second liquid (preferably a catalyst for initiating curing of the ink), as described with reference to the first embodiment. This allows initiation of a chemical reaction between the first liquid of the first primary drop 221A and the second liquid of the second primary drop 221B for curing of the ink in the combined drop 222 before it reaches the surface to be printed, so that the ink may adhere more easily to the printed surface and/or cure more quickly at the printed surface.

The chemical reaction is initiated at the connection point 232 (at which the first path crosses with the second path) within a reaction chamber, which is in this embodiment formed by the primary enclosure 241.

In the second embodiment, the ink drop is combined with the catalyst drop within the reaction chamber 241, i.e. before combined drop 222 exits the primary enclosure 241. The head construction is such that the nozzle outlets 213A, 213B are separated from each other by the separator 231, which does not allow the primary drops 221A, 221B to combine at the nozzle outlets 213A, 213B. Therefore, the ink and the catalyst will not mix directly at the nozzle outlets 213A, 213B, and the combined drop 222 will not touch any element of the printing head during its flow along the combined drop path, which prevents the nozzle outlets 213A, 213B from clogging. Once the drops are combined to a combined drop 222, there is no risk of clogging of the primary enclosure 241 at the connection point or downstream the enclosure 241, as the combined drop 222 is already separated from the nozzle outlets 213A, 213B and the stream of gas 271A, 271B (which preferably flows continuously) can effectively remove any residuals that would stick to the separator 231 or enclosure walls 241 before solidifying. The enclosure 241 guides the drops 221A, 221B, 222 towards its axis, therefore the drops 221A, 221B, 222 are guided in a controlled and predictable manner. It is therefore easy to control drop placement of the combined drop 222 on the surface to be printed. Even if, due to differences in size or density of the primary drops 221A, 221B, the combined drop 222 would tend to deviate from the axis of the primary enclosure 241, it will be aligned with its axis at the end of the enclosure 241, and therefore exit the enclosure 241 along its axis. Therefore, even relatively large-size drops and primary drops having different sizes can be combined due to the use of the primary enclosure 241 in a more predictable manner than in the prior art solutions where drops combine in-flight outside the printhead.

Therefore, the separator 231 and primary enclosure 241 function as a guide for the primary drops 221A, 221B within the reaction chamber from the nozzle outlet 213A, 213B to a connection point 232. The separator 231 and the first section 243 of the primary enclosure restrict the freedom of combination of primary drops 221A, 221B into a combined drop 222, and the separator 231 and the first section 243 impact the further path of travel of the combined drop 222—downwards, towards the outlet of the first section 243.

The separator 231 may have the same properties as the separator 131 described for the first embodiment.

The inclination angles βA, βB of the nozzle channels 212A, 212B (which are in this embodiment also the ejection angles γB, γB at which the primary drops are ejected from the nozzle channels) as shown in FIGS. 4A and 4B are the same as the inclination angles αA, αB of the side walls of the separator 231, so that the primary drops 221A, 221B are ejected from the nozzles in parallel to the separator walls. In alternate embodiments, they may be larger than the corresponding inclination angles αA, αB of the separator walls, so that the ejected primary drops 221A, 221B are forced into contact with the separator walls.

However, an alternate embodiment is possible, wherein the inclination angles βA, βB of the nozzle channels 212A, 212B and the ejection angles γB, γB are smaller than the inclination angles αA, αB of the side walls of the separator 231, which may cause the ejected primary drops to separate from the side walls of the separator 231 and combine further downstream, i.e. below the tip of the separator. In such a case the separator 231 functions as a guide for the primary drops 221A, 221B only partially and its main function is to separate the nozzle outlets 213A, 213B so as to prevent them from clogging. In that case, it is mostly the stream of gas 271A, 271B formed by the inside walls of the preliminary enclosure 241 that acts this way (i.e. via moving gas) as means for guiding the primary drops 221A, 221B within the reaction chamber 241 from the nozzle outlet 213A, 213B to a connection point. The freedom of combination of primary drops 221A, 221B into the combined drop 222 at the connection point is then also restricted by the force of the stream of gas 271A, 271B formed by the internal walls of the primary enclosure 241.

The nozzles 212A, 212B shown in FIG. 4A are symmetrical, i.e. their angles of inclination βA, βB, and the ejection angles γB, γB are the same with respect to the axis of the head 200 or of the nozzle arrangement 210. In alternative embodiments, the nozzles 212A, 212B may be asymmetric, i.e. the angles βA, βB or γB, γB may be different, depending on the parameters of liquids supplied from the nozzle outlets 213A, 213B.

The inclination angles βA, βB and the ejection angles γB, γB can be from 0 to 90 degrees, preferably from 5 to 75 degrees, and more preferably from 15 to 45 degrees.

The primary enclosure 241 can be replaceable, which allows to assembly the head 210 with an enclosure 241 having parameters corresponding to the type of liquid used for printing. For example, enclosures 241 of different diameters D1 of the first section 243 can be used, depending on the actual features and size, as well as desired exit velocity of the combined drop 222. The angles of inclination βA, βB of the nozzles 211A, 211B can be adjustable, to adjust the nozzle assembly 210 to parameters of the liquids stored in the reservoirs 216A, 216B.

The first section 243 of the primary enclosure 241 has preferably a length L1 not shorter than the diameter dC of the combined drop 222, and preferably the length L1 equal to a few diameters dC of the combined drop 222, to set its path of movement precisely for precise drop placement control.

The internal surface of the primary enclosure 241, especially at the first section 243 and at the second section 244 has preferably a low friction coefficient and low adhesion in order to prevent the drops 221A, 221B, 222 or residuals of their combination from adhering to the surface, helping to keep the device clean and allow the eventual residuals to be blown off by the stream of gas 271A, 271B. Moreover, the internal walls of the primary enclosure 241 are inclined such as to provide a low contact angle between the side walls and the primary drops, which could accidentally hit the internal walls, such as to decrease adhesion and facilitate drop bouncing. In order to prevent any residue build-up side walls of the separator as well as primary enclosure are smooth with sharp edge endings, preferably covered in material having high contact angle to the primary drop liquid. The stream of gas preferably prevents also any particles from the outside environment to contaminate the inside of the primary enclosure 243.

The printing head may further comprise a secondary enclosure 251 which surrounds the primary enclosure 241 and has a shape corresponding to the primary enclosure 241 but a larger cross-sectional width, such that a second stream of gas 272, supplied from the pressurized gas inlet 219, can surround the outlet of the first section 243 of the primary enclosure 241, so that the combined drop 222 exiting the primary enclosure 241 is further guided downstream to facilitate control of its path. The gas stream 272 may further increase its velocity in the area of second outlet section 253 due to its shape and thus further accelerate the drop 222 exiting the primary enclosure 241. The surface of the cross section of the gas stream 272 decreases downwards which would cause the stream of gas 272 to reach the velocity not lower, but preferably higher than that of the combined drop 222 in the moment of leaving the section 243 of primary enclosure 241. In order to further increase the drop velocity the cross-section of the second outlet section 253 of the secondary enclosure 251, which is between the outlet of the primary enclosure and the first outlet section 252 of the secondary enclosure, is preferably decreasing downstream such as to direct the stream of gas 272 towards the central axis. The first outlet section 252 of the secondary enclosure 251 has preferably a round cross-section and a diameter D2 that is preferably larger (preferably, at least 2 times larger) than the diameter D1 of the outlet of the section 243 of the primary enclosure, such that the combined drop 222 does not touch the internal side all of the secondary enclosure 251 to prevent clogging and is guided by the (now combined) streams of gas 271A, 271B, 272 between the combined drop 222 and the side walls of the secondary enclosure 251. Moreover, the secondary enclosure may have perforations (openings) 255 in the first outlet section 252, to aid in decompression of the gas stream in a direction other than the flow direction of the combined drop. Preferably, the diameter D2 is at least 2 times greater than the diameter dC of the combined drop. Preferably, the length L2 of the first outlet section 252 is from zero to a multiple of diameters dC of the combined drop 222, such as 10, 100 or even 1000 times the diameter dC, in order to guide the drop in a controllable manner and provide it with desired kinetic energy. This may significantly increase the distance at which the combined drop 222 may be ejected from the printing head and still maintain the precise drop placement on the printed surface, which allows to print objects of variable surface. Moreover, this may allow to eject drops at an angle to the vector of gravity, while keeping satisfactory drop placement control. Moreover, relatively high length L2 may allow the combined drop to pre-cure before reaching the substrate 290.

In the outlet sections 252, 253 of the secondary enclosure 251 the gas increases its velocity thus decreasing its pressure and consequently lowering its temperature. This may cause the increase of velocity and the decrease of the temperature of the combined drop 222, which remains within the gas stream. Lowering the temperature of the combined drop 222 may increase its viscosity and adhesion, which is desirable in the moment of reaching the substrate by the drop helping the drop to remain in the target point and preventing it from flowing sidewise.

The second embodiment may further comprise a cover 281, having configuration and functionality as described for the cover 181 of the first embodiment, including the heating elements and temperature sensor (not shown for clarity of drawing).

Therefore, that embodiment can be used in drop on demand printing method to discharge the first primary drop 221A of the first liquid to move along the first path and to discharge the second primary drop 221B of the second liquid to move along the second path; and to control, by means of the surface of the separator (i.e. by means of a surface of a printing head element) and the streams of gas, the flight of the first primary drop 221A and the second primary drop 221B to combine the first primary drop 221A with the second primary drop 221B at the connection point 232 within the reaction chamber 241 within the printing head so that a chemical reaction is initiated within a controlled environment of the reaction chamber 241 between the first liquid of the first primary drop 221A and the second liquid of the second primary drop 221B.

Figure 4C:
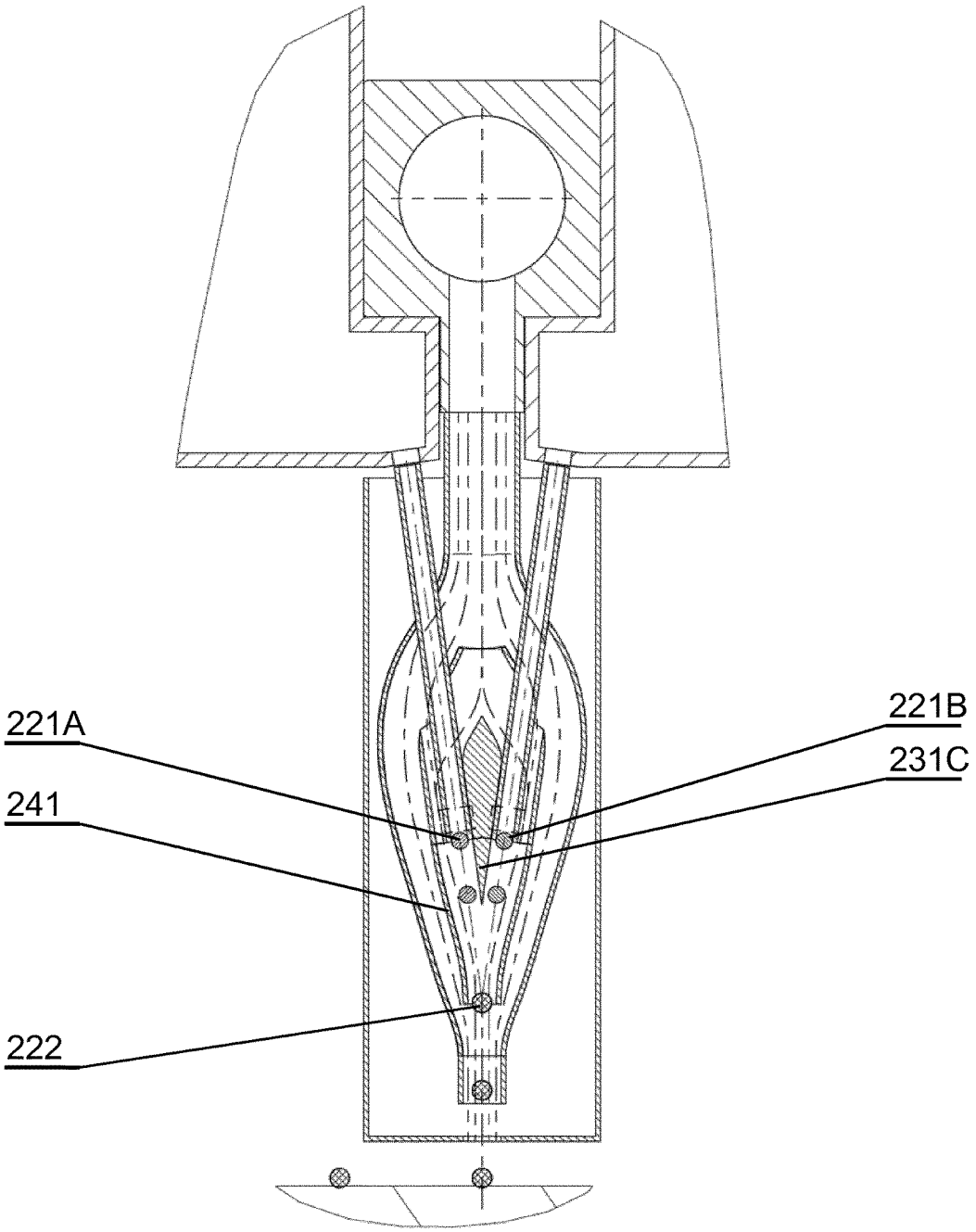
FIG. 4C shows schematically the second variant of the second embodiment of the invention.

The second variant of the second embodiment, as shown in FIG. 4C, differs from the first variant of FIG. 4A in that the side walls of separator 231C are slightly offset (not adjacent) from the internal side walls of the nozzle outlets, such that the primary drops 221A, 221B that are discharged are not immediately in contact with the side walls of the separator 231C. In that case, there is formed a thin layer of gas between the side walls of the separator 231C and the primary drops 221A, 221B. However, since the separator 231C restricts the freedom of gas flow and therefore the freedom of flow of the primary drops from the nozzle outlets towards the connection point, the separator 231C can be considered as indirectly guiding the primary drops. Similarly as to the variant of the first embodiment shown in FIG. 2E, it is mostly the downstream-narrowing tubular end of the primary enclosure 241 that, along with the gas streams 271A, 271B that separate it from the walls of the primary enclosure 241, restricts the freedom of combination of the primary drops into a combined drop 222 at the connection point and/or shapes the combined drop and aligns its output flow axis.

Third Embodiment

Figure 7:
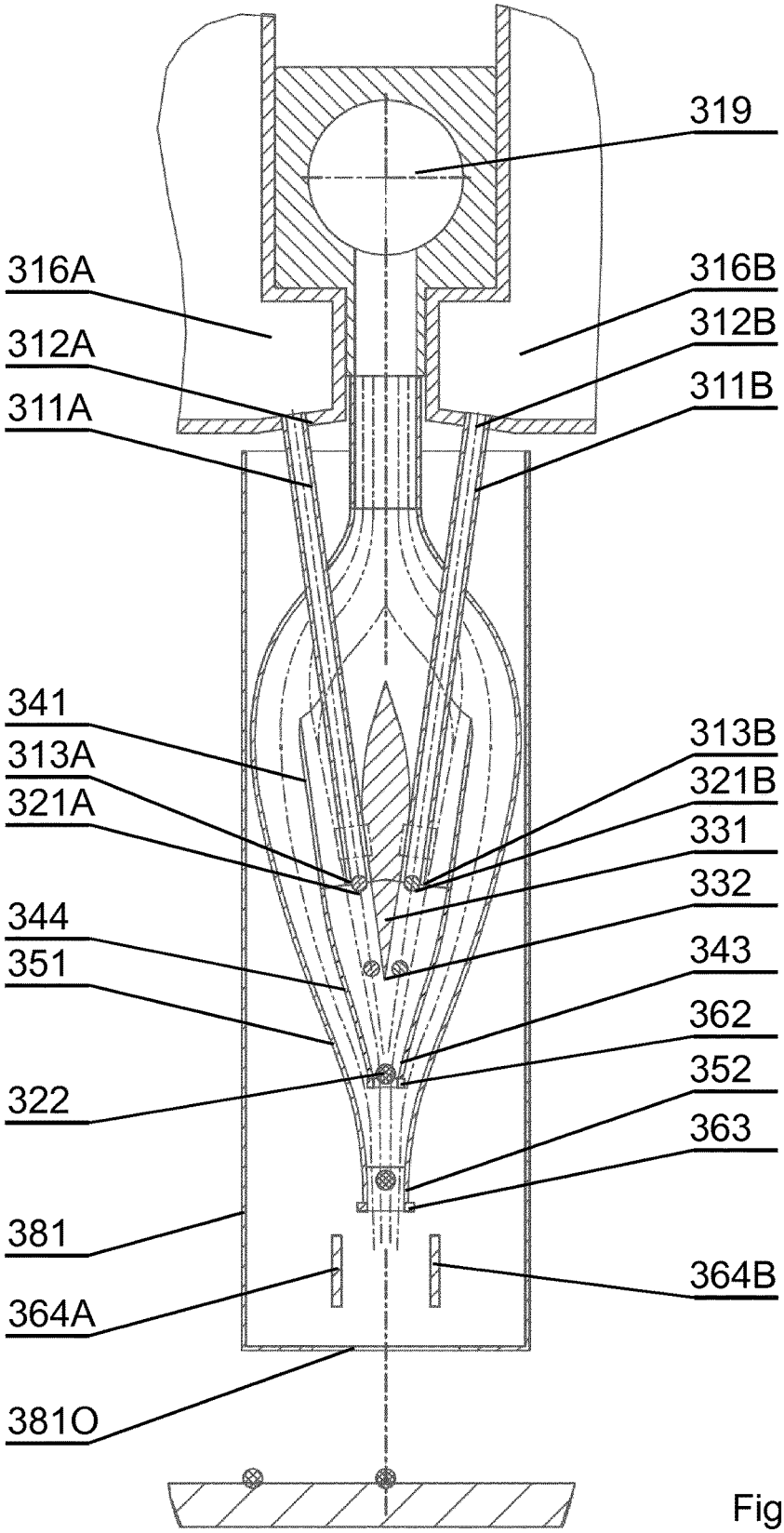
FIG. 7 shows schematically the third embodiment of the invention.

The third embodiment of the head 300 is shown schematically in a longitudinal cross-section on FIG. 7. It has most of its features in common with the second embodiment, with the following differences.

At the first section 343 of the primary enclosure 341 and at the first section 352 of the secondary enclosure 351, there are charging electrodes 362, 363 which apply electrostatic charge to the combined drop 322.

Moreover, downstream, behind at the first outlet section 352 of the secondary enclosure 351 there are deflecting electrodes 364A, 364B which deflect the direction of the flow of the charged drops 322 in a controllable direction. Thereby, the drop 322 placement can be effectively controlled. In order to allow change of the outlet path of the drops 322 from the inside of the head 300, the output opening 3810 of the cover 381 has an appropriate width so that the deflected drop 322 does not come into contact with the cover 381.

The charging electrodes 362, 363 and the deflecting electrodes 364A, 364B can be designed in a manner known in the art from CIJ technology and therefore do not require further clarification on details.

The other elements, having reference numbers starting with 3 (3xx) correspond to the elements of the second embodiment having reference numbers starting with 2 (2xx).

Fourth Embodiment

Figure 8:
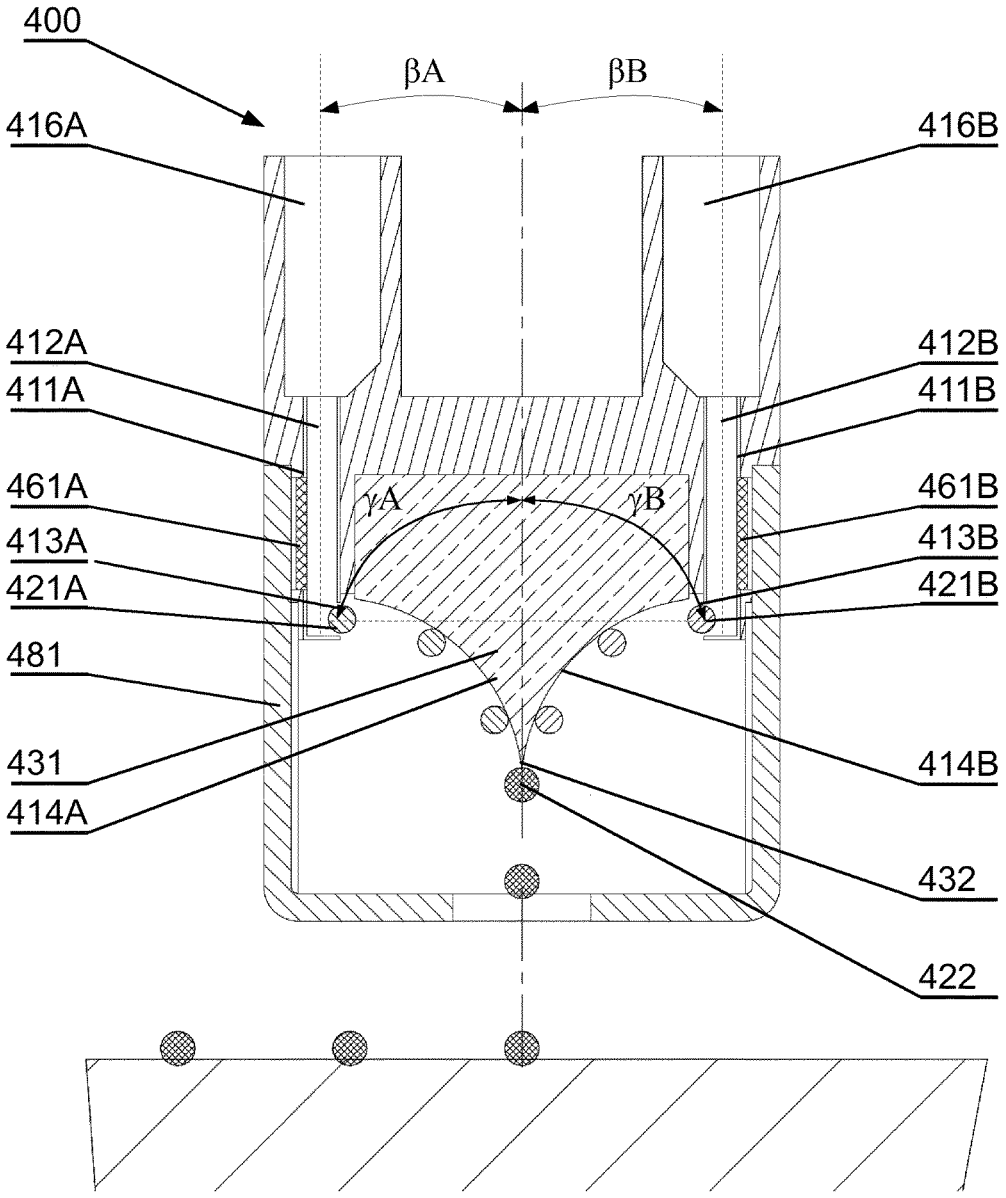
FIG. 8 shows schematically the fourth embodiment of the invention.

A fourth embodiment of the inkjet printing head 400 according to the invention is shown in FIG. 8 in a detailed cross-sectional view. Unless otherwise specified, the fourth embodiment shares common features with the first embodiment.

The inkjet printing head 400 may comprise one or more nozzle assemblies, each configured to produce a combined drop 422 formed of two primary drops 421A, 421B ejected from a pair of nozzles 411A, 411B separated by a separator 431. The embodiment can be enhanced by using more than two nozzles. Each nozzle 411A, 411B of the pair of nozzles in the nozzle assembly has a channel 412A, 412B for conducting liquid from a reservoir 416A, 416B. At the nozzle outlet 413A, 413B the liquid is formed into primary drops 421A, 421B as a result of operation drop generating and propelling devices 461A, 461B shown on FIGS. 10, 11, 12. The nozzle outlets 413A, 413B are separated by a separator 431 having a downstream-narrowing cross-section that separates the nozzle outlets 413A, 413B and thus prevents the undesirable contact between primary drops 421A and 421B prior to their full discharge from their respective nozzle outlets 413A and 413B.

The nozzles 412A, 412B have drop generating and propelling devices 461A, 461B for ejecting the drops to move respectively along a first path and a second path, which are only schematically marked in FIG. 8, and their schematically depicted types are shown in FIGS. 10-12. The drop generating and propelling devices may be for instance of thermal (FIG. 10), piezoelectric (FIG. 11) or valve (FIG. 12) type. In case of the valve the liquid would need to be delivered at adequate pressure.

The printing head further comprises a cover 481 which forms the reaction chamber and protects the head components, in particular the separator tip 432 and the nozzle outlets 413A, 413B, from the environment, for example prevents them from touching by the user or the printed substrate.

In the fourth embodiment, the ejection angles $\gamma$A, $\gamma$B at which the primary drops 421A, 421B are ejected from the nozzle channels 412A, 412B are equal to 90 degrees, i.e. the primary drops 421A, 421B are ejected along the first path and the second path that are initially arranged perpendicularly to the longitudinal axis of the head. In this embodiment, the nozzle inclination angles $\beta$A, $\beta$B are equal to 0 degrees, i.e. the nozzle channels are parallel to the longitudinal axis of the head, but in other embodiments they can be different. Next, the ejected primary drops 421A, 421B are guided along the separator 431, which has concave side walls 414A, 414B, towards its tip 432, where they combine to form a combined drop 422, which separates from the separator tip 432 and travels towards the surface to be printed. In this embodiment it is the geometry of the separator, and not of the nozzles, that determines collision parameters of the primary drops allowing for full coalescence. Therefore, the separator 431 functions as means for controlling the flight of the first primary drop 421A and the second primary drop 421B, and in particular for altering the first path and the second path before the connection point, to allow the first primary drop 421A to combine with the second primary drop 421B at the connection point 432 into the combined drop 422 within the reaction chamber 481.

The separator can be exchangeable, allowing for the modification of collision parameters. Furthermore, any residual drops being formed from the nozzles may be guided along the side walls of the separator and outside the printing head and also by means of the stream of gas flowing alongside the path of the primary drops and—from the connection point—alongside the path of the combined drop.

Therefore, that embodiment can be used in drop on demand printing method to discharge the first primary drop 421A of the first liquid to move along the first path and to discharge the second primary drop 421B of the second liquid to move along the second path; and to control, by means of the separator, the flight of the first primary drop 421A and the second primary drop 421B to combine the first primary drop 421A with the second primary drop 421B at the connection point 432 within the reaction chamber 481 within the printing head so that a chemical reaction is initiated within a controlled environment of the reaction chamber 481 between the first liquid of the first primary drop 421A and the second liquid of the second primary drop 421B.

Fifth Embodiment

Figure 9:
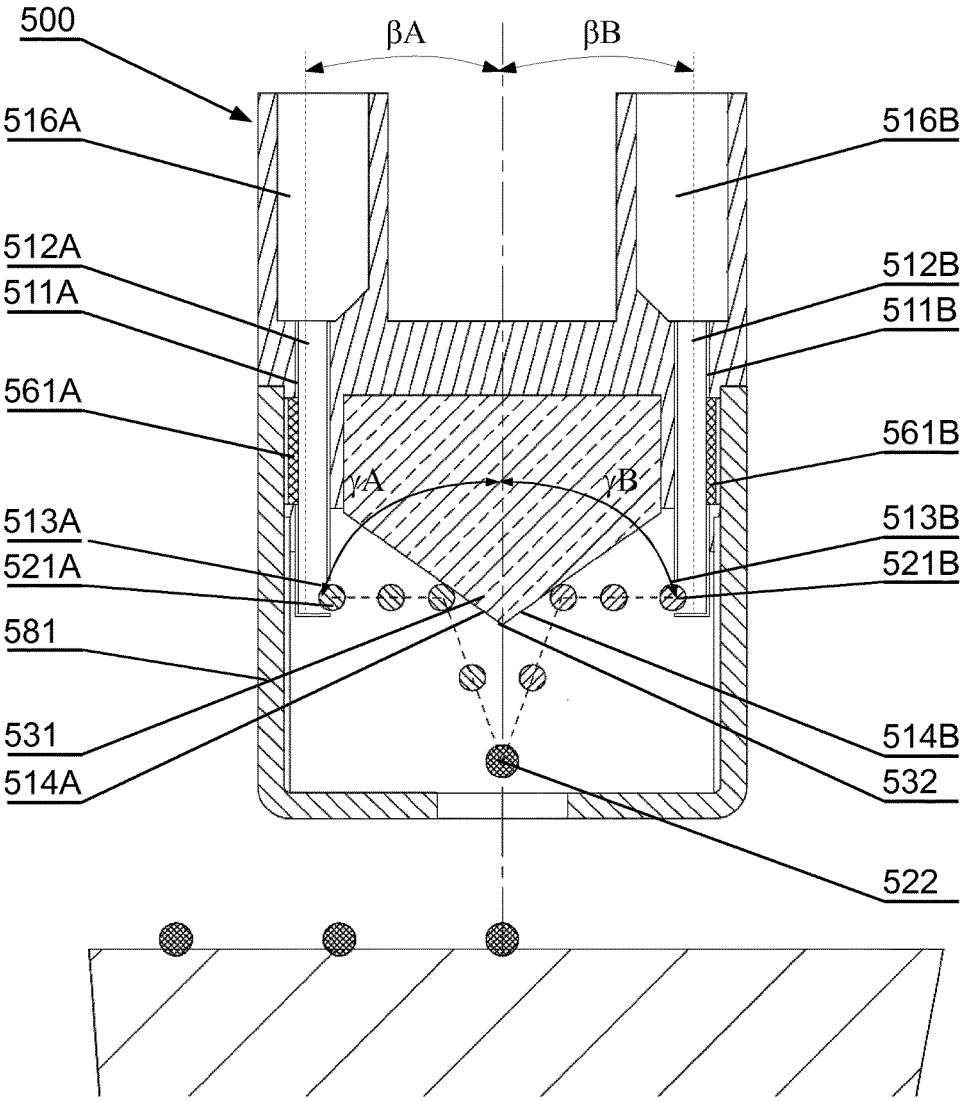
FIG. 9 shows schematically the fifth embodiment of the invention.

A fifth embodiment of the inkjet printing head 500 according to the invention is shown in FIG. 9 in a detailed cross-sectional view. Unless otherwise specified, the fourth embodiment shares common features with the first embodiment.

The inkjet printing head 500 may comprise one or more nozzle assemblies, each configured to produce a combined drop 522 formed of two primary drops 521A, 521B ejected from a pair of nozzles 511A, 511B separated by a separator 531. The embodiment can be enhanced by using more than two nozzles. Each nozzle 511A, 511B of the pair of nozzles in the nozzle assembly has a channel 512A, 512B for conducting liquid from a reservoir 516A, 516B. At the nozzle outlet 513A, 513B the liquid is formed into primary drops 521A, 521B as a result of operation drop generating and propelling devices 561A, 561B shown on FIGS. 10, 11, 12. The nozzle outlets 513A, 513B are separated by a separator 531 having a downstream-narrowing cross-section that separates the nozzle outlets 513A, 513B and thus prevents the undesirable contact between primary drops 521A and 521B prior to their full discharge from their respective nozzle outlets 513A and 513B.

The nozzles 512A, 512B have drop generating and propelling devices 561A, 561B for ejecting the drops to move respectively along a first path and a second path, which are only schematically marked in FIG. 9 and their schematically depicted types are shown in FIGS. 10-12. The drop generating and propelling devices may be for instance of thermal (FIG. 10), piezoelectric (FIG. 11) or valve (FIG. 12) type. In case of the valve the liquid would need to be delivered at some pressure.

The printing head further comprises a cover 581 which forms the reaction chamber and protects the head components, in particular the separator tip 532 and the nozzle outlets 513A, 513B, from the environment, for example prevents them from touching by the user or the printed substrate.

In the fifth embodiment, the ejection angles γA, γB at which the primary drops 521A, 521B are ejected from the nozzle channels 512A, 512B are equal to 90 degrees, i.e. the primary drops 521A, 521B are ejected along the first path and the second path which are initially set perpendicularly to the axis of the head. Next, the first and second paths (i.e. the trajectory of the ejected primary drops 521A, 521B) are changed by bouncing from the side walls 514A, 514B of the separator, which are preferably flat, so that their trajectory is redirected towards a connection point where they combine to form a combined drop 522, which travels towards the surface to be printed. The angle of incidence determines the angle of reflection thus the trajectory of the drop is determined by the angle of inclination of the walls of the separator. In this embodiment, the primary drops coalesce at the connection point which is downstream in relation to the tip of the separator.

Sixth Embodiment

Figure 13A:
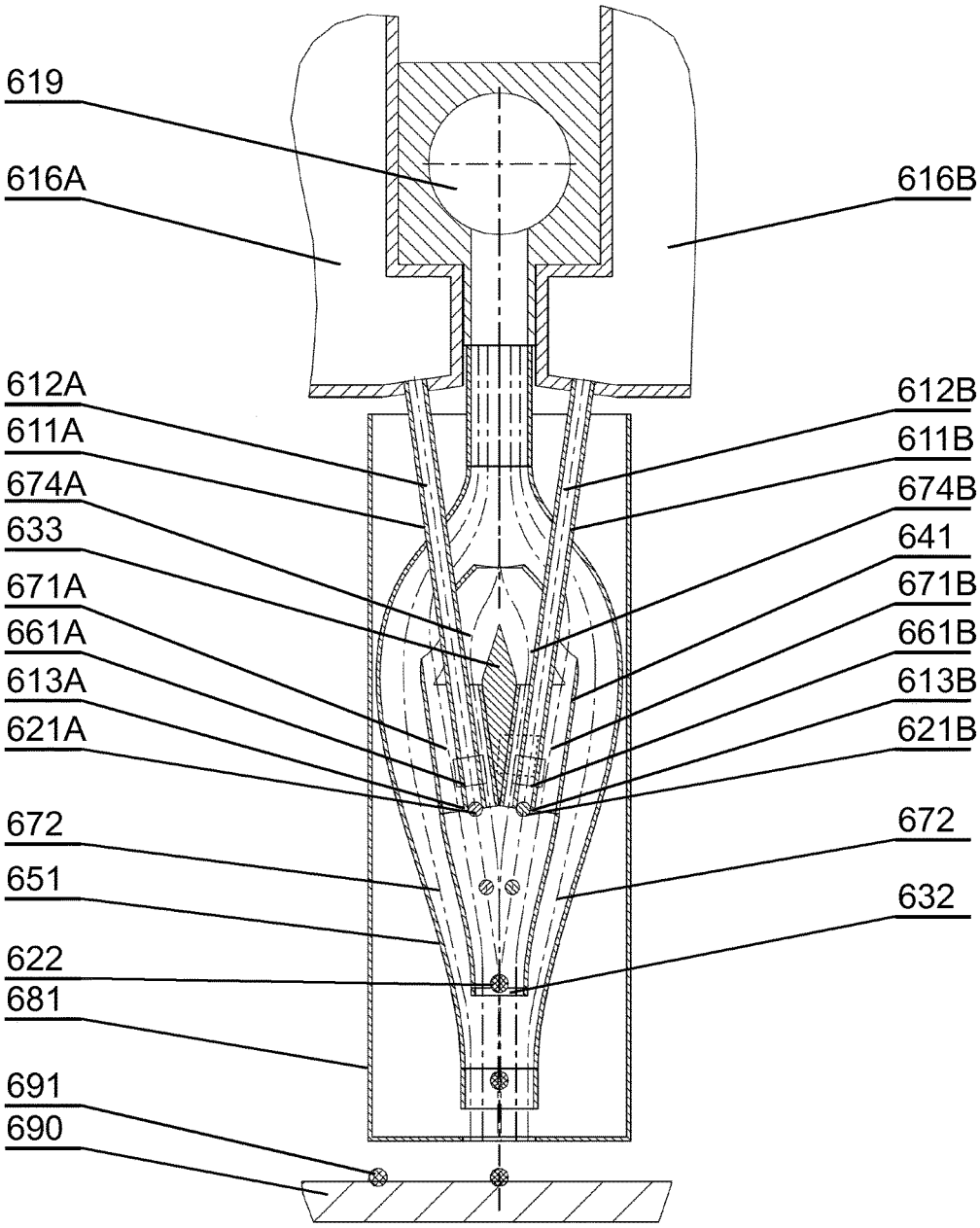
FIG. 13A shows schematically the first variant of a sixth embodiment of the invention.

The sixth embodiment of the head 600 is shown in an overview, in a first variant, in FIG. 13A. The sixth embodiment 600 has most of its features in common with the second embodiment, with the main difference such that it does not comprise the separator 231.

The primary drops 621A, 621B ejected from the nozzle outlets 613A, 613B move along respectively a first path and a second path towards a connection point 632, where they combine to form a combined drop 622 and travels towards the surface to be printed.

The primary drops 621A, 621B are guided by streams 671A, 671B and 674A, 674B of gas (such as air or nitrogen, provided from a pressurized gas input 619, having a pressure of preferably 5 bar) inside primary enclosure 641. The shape of the primary enclosure 641 in its upper part helps to direct the stream of gas alongside the nozzles 611A, 611B and guides drops from the outlets 613A, 613B of the nozzles 611A, 611B towards the connection point at which they join to form the combined drop 622.

Therefore, the streams 671A, 671B of gas function as means for controlling the flight of the first primary drop 621A and the second primary drop 621B to allow the first primary drop 621A to combine with the second primary drop 621B at the connection point 632 into the combined drop 622.

The chemical reaction is initiated at the connection point 632 (at which the first path crosses with the second path) within a reaction chamber, which is in this embodiment formed by the primary enclosure 641.

The nozzles 611A, 611B can be separated by a blocking element 633 (which is however separate from the nozzles 611A 611B), such that streams of gas 671A, 671B may form between the nozzles 611A, 611B and the primary enclosure 641 and streams of gas 674A, 674B may form between the nozzles 611A, 611B and the blocking element 633.

Alternatively, the head may have no blocking element 633, then the streams of gas 674A, 674B will not be directed in parallel to the axes of the nozzles 611A, 611B. However, due to the directions of streams 671A, 671B, the control over path of movement of the primary drops 621A, 621B may still be possible.

The nozzle outlets 613A, 613B may be heated to a temperature higher than the temperature of the environment. The liquids in the reservoirs 616A, 616B may be also preheated. Increased temperature of working fluids (i.e. the first liquid and the second liquid) may also lead to improved coalescence process of primary drops and preferably increase adhesion and decrease the curing time of the combined drop 622 when applied on the substrate.

The other elements, having reference numbers starting with 6 (6xx) correspond to the elements of the second embodiment having reference numbers starting with 2 (2xx).

Therefore, that embodiment can be used in drop on demand printing method to discharge the first primary drop 621A of the first liquid to move along the first path and to discharge the second primary drop 621B of the second liquid to move along the second path; and to control, by means of the streams of gas, the flight of the first primary drop 621A and the second primary drop 621B to combine the first primary drop 621A with the second primary drop 621B at the connection point 632 within the reaction chamber 641 within the printing head so that a chemical reaction is initiated within a controlled environment of the reaction chamber 641 between the first liquid of the first primary drop 621A and the second liquid of the second primary drop 621B.

Figure 13B:
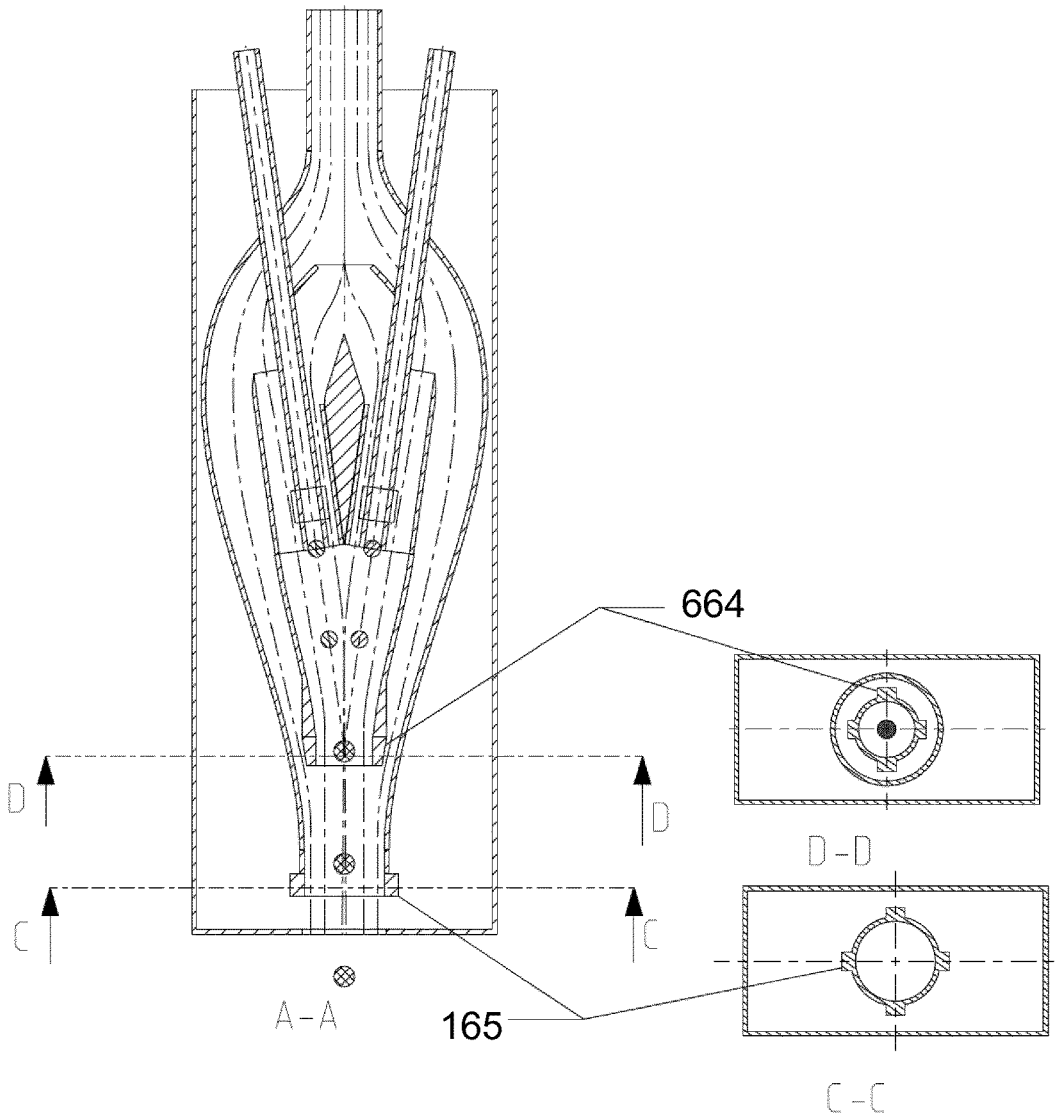
FIG. 13B shows schematically the second variant of the sixth embodiment of the invention.

In a second variant of the sixth embodiment, shown schematically in FIG. 13B, one or both of the liquids stored in liquid reservoirs 616A, 616B may be pre-charged with a predetermined electrostatic charge, such that one or both of the primary drops exiting the nozzle outlets are charged, which may facilitate combination of primary drops 621A, 621B to a combined drop 622. As shown in FIG. 13B, the outlet of the primary enclosure 641 may contain a set of electrodes 664, which generate electrical field that forces the charged combined drop 622 to be aligned with the longitudinal axis of the head. Moreover, the outlet of the secondary enclosure 651 may contain a set of electrodes 665, which generate electrical field that forces the charged combined drop 622 to be aligned with the longitudinal axis of the head. Both or only one of the electrodes set 664, 665 may be used. Preferably, the sets 664, 665 each comprise at least 3 electrodes, or preferably 4 electrodes, which are distributed evenly along the circumference of a circle, such as to force the drop 622 towards the central axis. Therefore, the sets of electrodes 664, 665 aid in drop placement. The other elements are equivalent to the first variant.

Figure 13C:
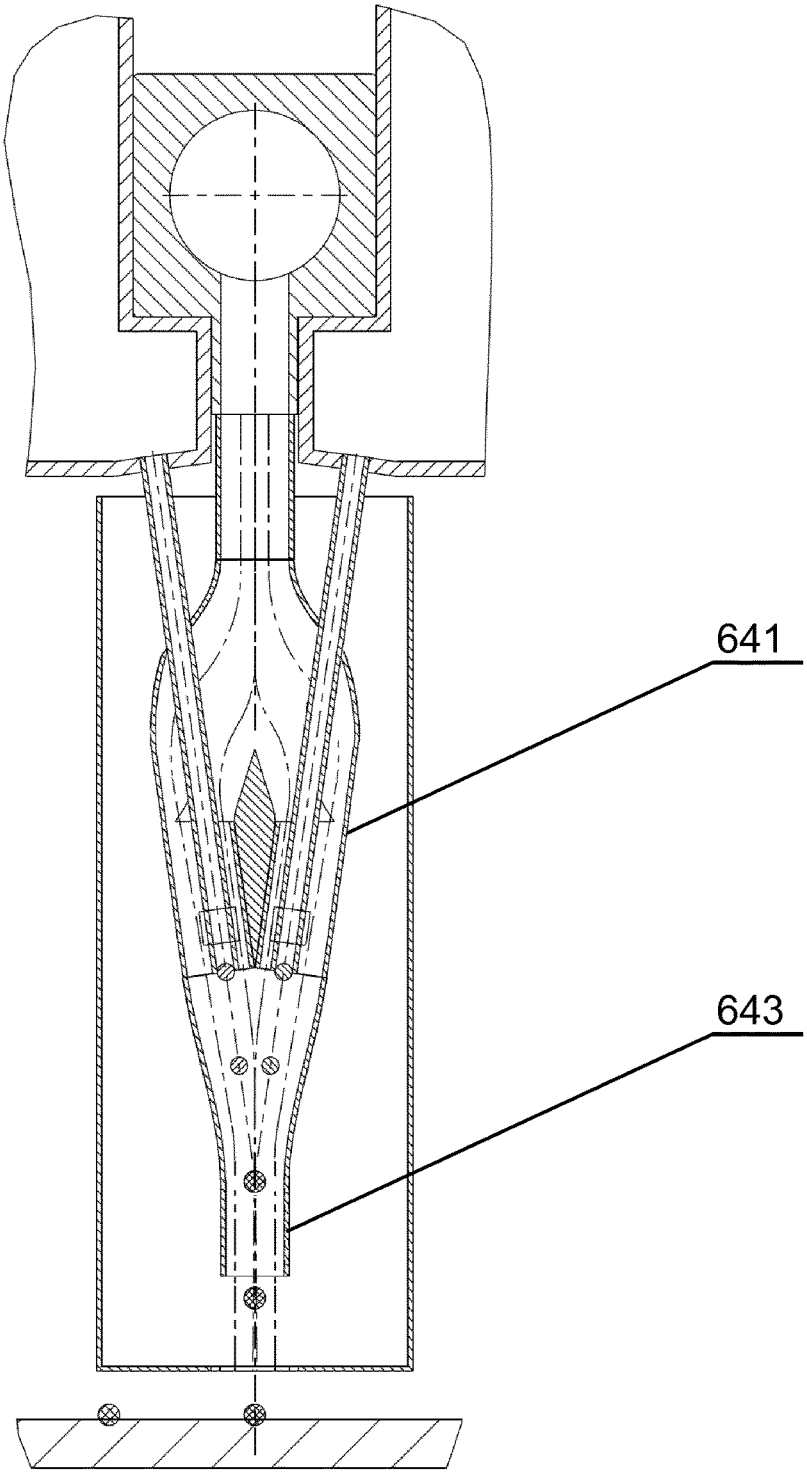
FIG. 13C shows schematically the third variant of the sixth embodiment of the invention.

In a third variant of that embodiment, shown schematically in FIG. 13C, only the primary enclosure 641 is present, without the secondary enclosure 651. The primary enclosure 641 has a longer first section 643 as compared to the first variant, which facilitates control over drop placement and may allow to increase the energy of the outlet combined drop. The other elements are equivalent to the first variant.

Figure 13D:
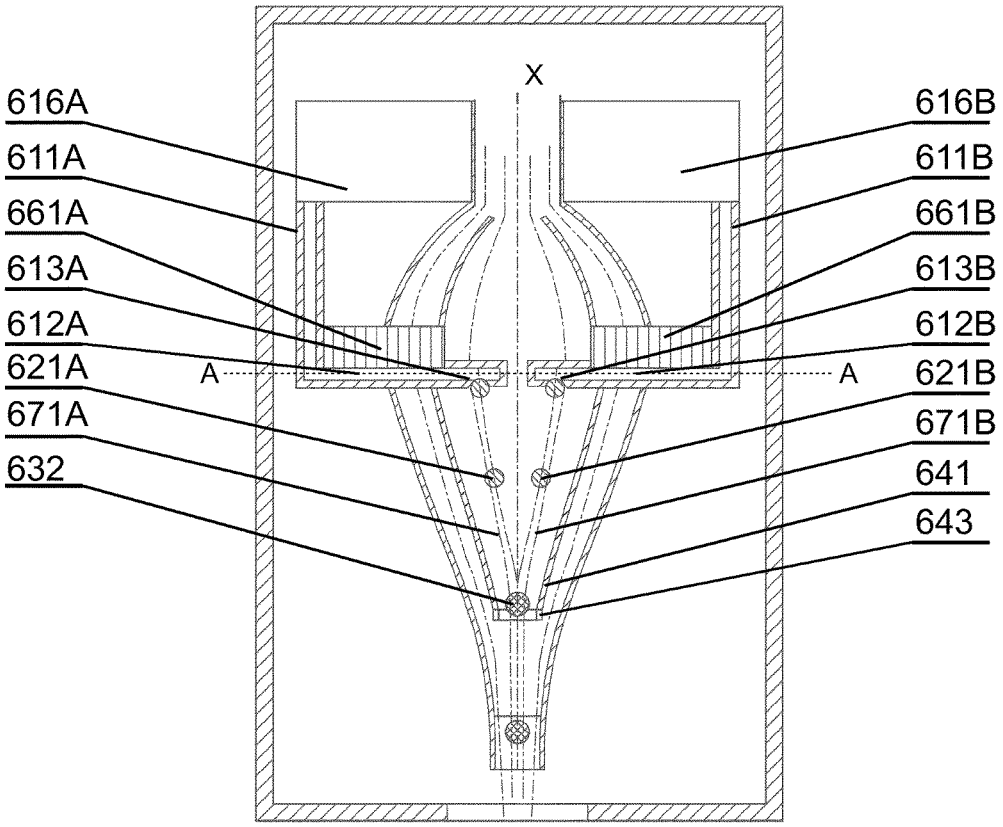
FIG. 13D-13F shows schematically the fourth variant of the sixth embodiment of the invention.
Figure 13E:
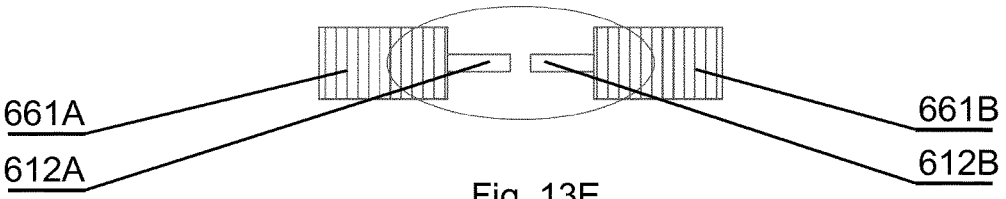
Figure 13F:
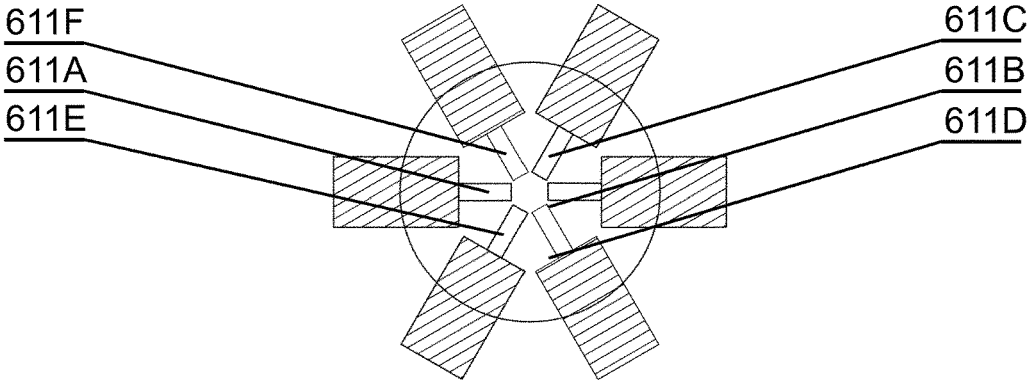

The fourth variant of that embodiment, shown schematically in FIGS. 13D and 13E, 13F (which are schematic cross-sections along the line A-A of FIG. 13D), differs from the first variant of FIG. 13A by the following. The nozzles 611A, 611B have the end sections of their channels 612A, 612B arranged substantially perpendicularly to the main axis of the printing head) and the nozzle outlets 613A, 613B are configured to eject the primary drops 621A, 621B such that they move along respectively a first path and a second path which are initially directed in parallel to the main axis X of the printing head.

Figure 16A:
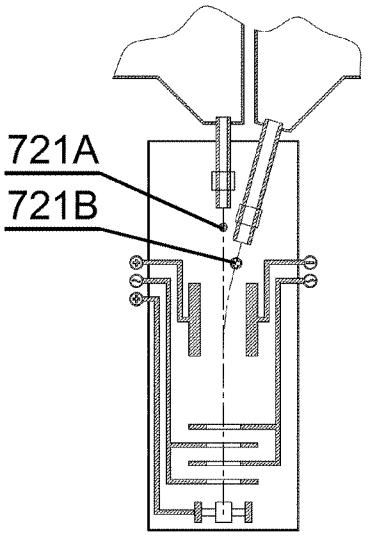
FIGS. 16A-16E show schematically the process of combination of primary drops to a combined drop in the seventh embodiment.
Figure 16B:
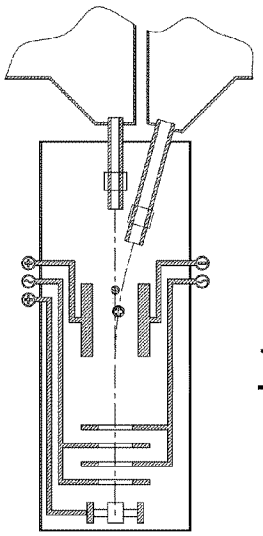
Figure 16C:
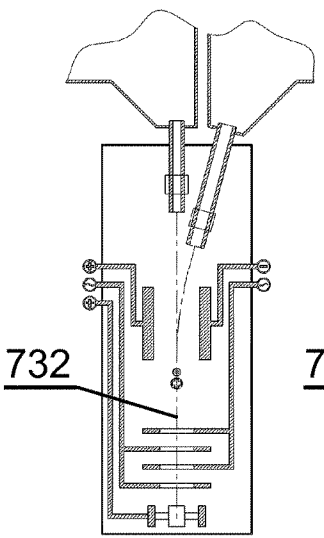
Figure 16D:
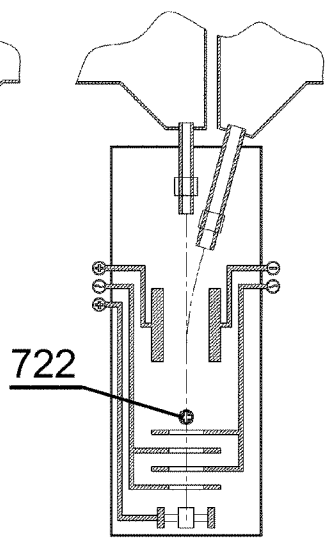
Figure 16E:
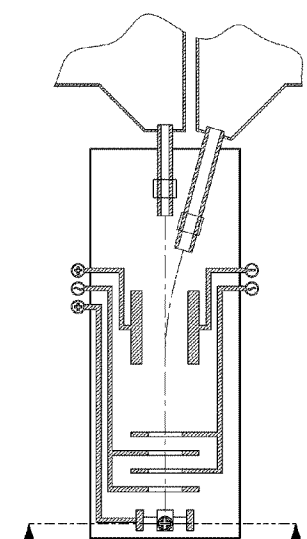

Such arrangement of the end sections of the nozzle channels 612A, 612B further allows to position relatively large (for example, piezoelectric) drop generating and propelling devices 661A, 661B, as shown in FIG. 16E.

FIG. 16F shows another variant, with a possibility to implement more than two (e.g. six) nozzles 612A-612F, each having its own drop generating and propelling device 661A-661F, each connected to an individual liquid reservoir, in order to allow generation of a combined drop from more than two primary drops. It shall be noted that in such case not all combined drops have to be combined from six drops, it is possible that for a particular combined drop only some of the nozzles 612A-612F provide primary drops, e.g. two, three, four or five nozzles, depending on the desired properties of the combined drop.

After being ejected, the primary drops 621A, 621B are guided by the streams of gas 671A, 671B within the primary enclosure 641, such that the first path and the second path are changed to cross each other at the connection point 632, which is located preferably at the downstream section 643 of the primary enclosure 641, which has preferably a constant, round cross-section of a diameter at least slightly larger (e.g. at least 110% or at least 150% or at least two times larger) than the desired diameter of the combined drop 622, and may be further configured such as described with respect to the section 243 of the second embodiment as shown in FIGS. 4A-4B.

Figure 13G:
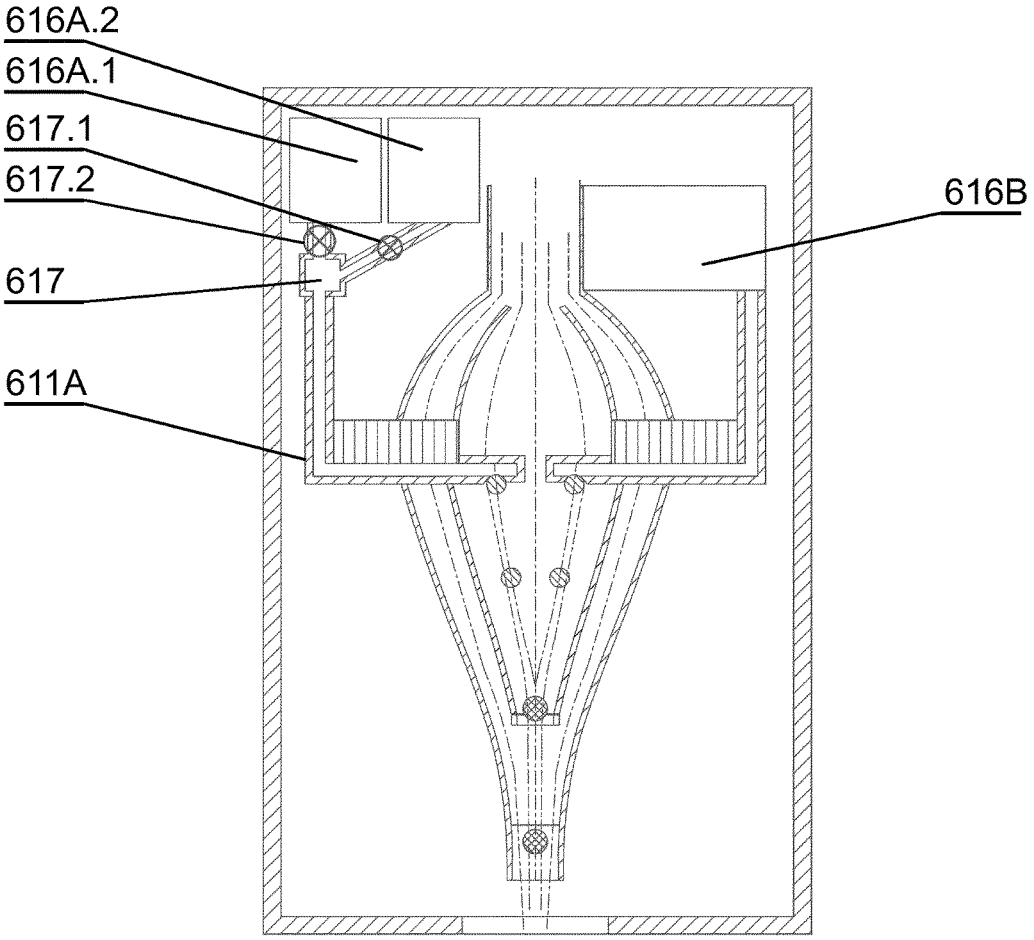
FIG. 13G shows schematically the fifth variant of the sixth embodiment of the invention.

The fifth variant of that embodiment, shown schematically in FIG. 13G, differs from the first variant of FIG. 13A by the following. At least one of the nozzles, in that example the first nozzle 611A, is connected to a mixing chamber 617, wherein liquid is mixed from a plurality of reservoirs 616A1, 616A2, from which the liquid is dosed by valves 617.1, 617.2. For example, the separate reservoirs 616A1, 616A2 may store inks of different colors, in order to supply from the first nozzle 611A a primary drop of ink having a desired color.

Figure 13H:
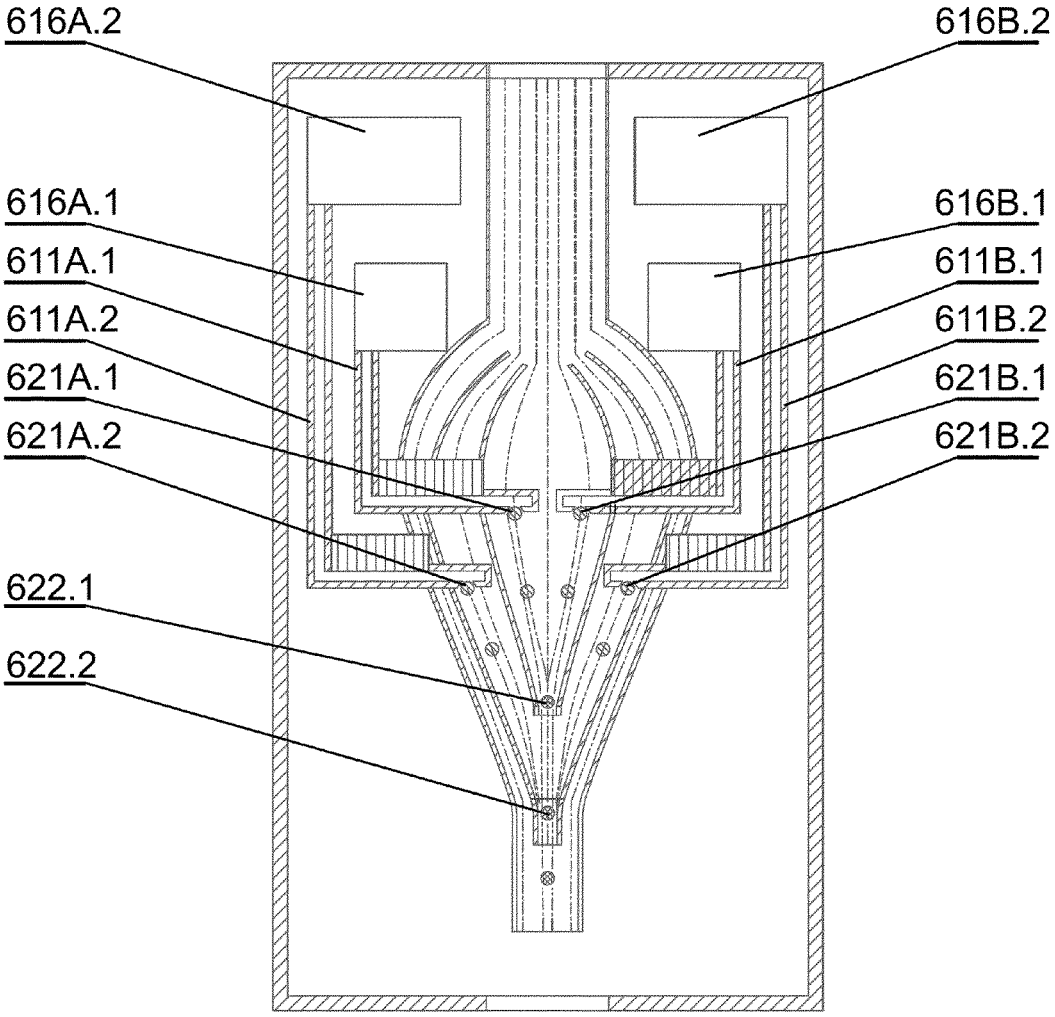
FIG. 13H shows schematically the sixth variant of the sixth embodiment of the invention.

The sixth variant of that embodiment, shown schematically in FIG. 13H, differs from the fourth variant of FIG. 13D-F by the following. The nozzles are arranged in a plurality of levels. The first level of nozzles 611A.1, 611B.1 (connected to liquid reservoirs 616A.1, 616B.1) is arranged such that they produce first level primary drops 121A.1, 121B.1 within the primary enclosure 641, which are guided by the streams of gas to combine into a first level combined drop 122.1. The second level of nozzles 611A.2, 611B.2 (connected to liquid reservoirs 616A.2, 616B.2) is arranged such that they produce second level primary drops 121A.2, 121B.2 within the secondary enclosure 651, which are guided by the streams of gas to combine into a second level combined drop 122.2. The second level combined drop 122.1 may be formed of only the second level primary drops 121A.2, 121B.2 (which allows to increase the drop generation frequency or variety of drop types that can be generated) or may be formed of the second level primary drops 121A.2, 121B.2 combined with the first level combined drop 122.1 (which allows to increase the variety of drop types from more than two components that can be generated).

Seventh Embodiment

Figure 14:
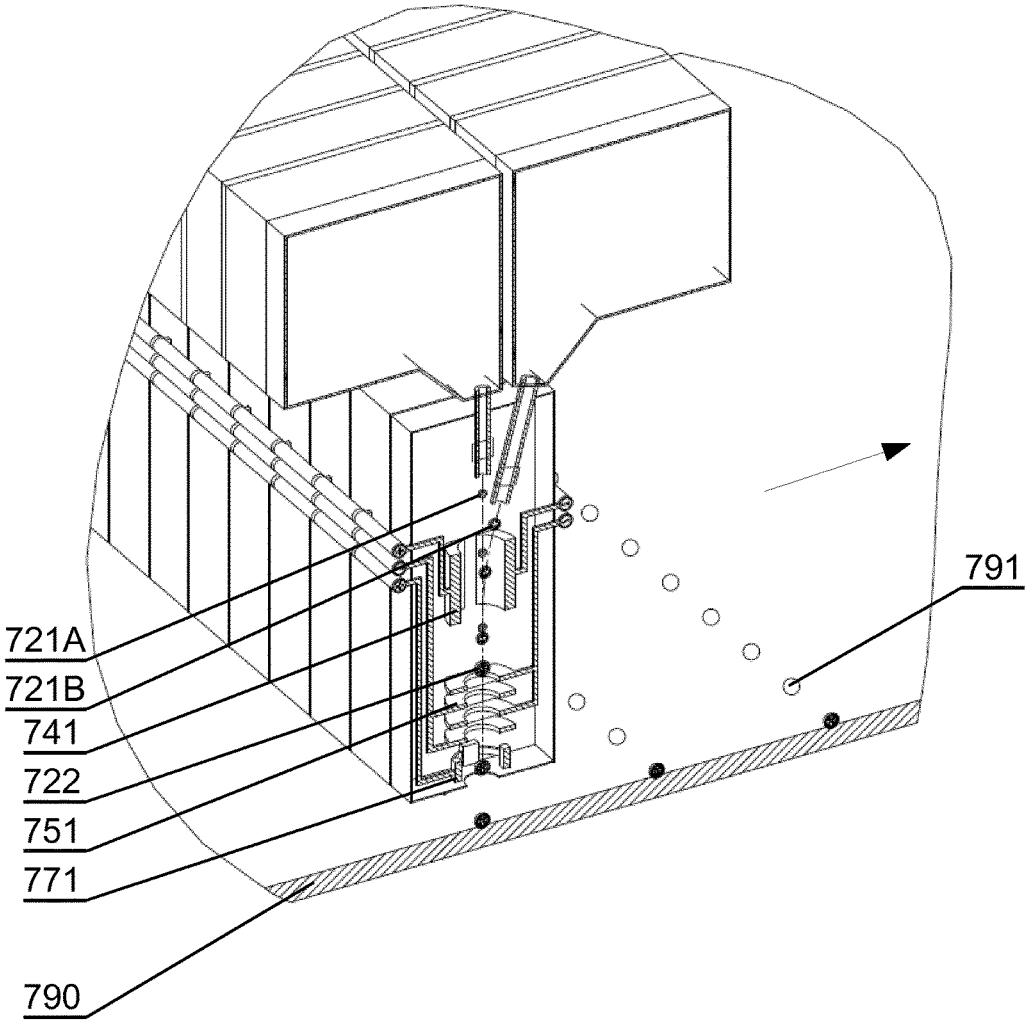
FIG. 14 shows schematically a printing head according to a seventh embodiment.
Figure 15A:
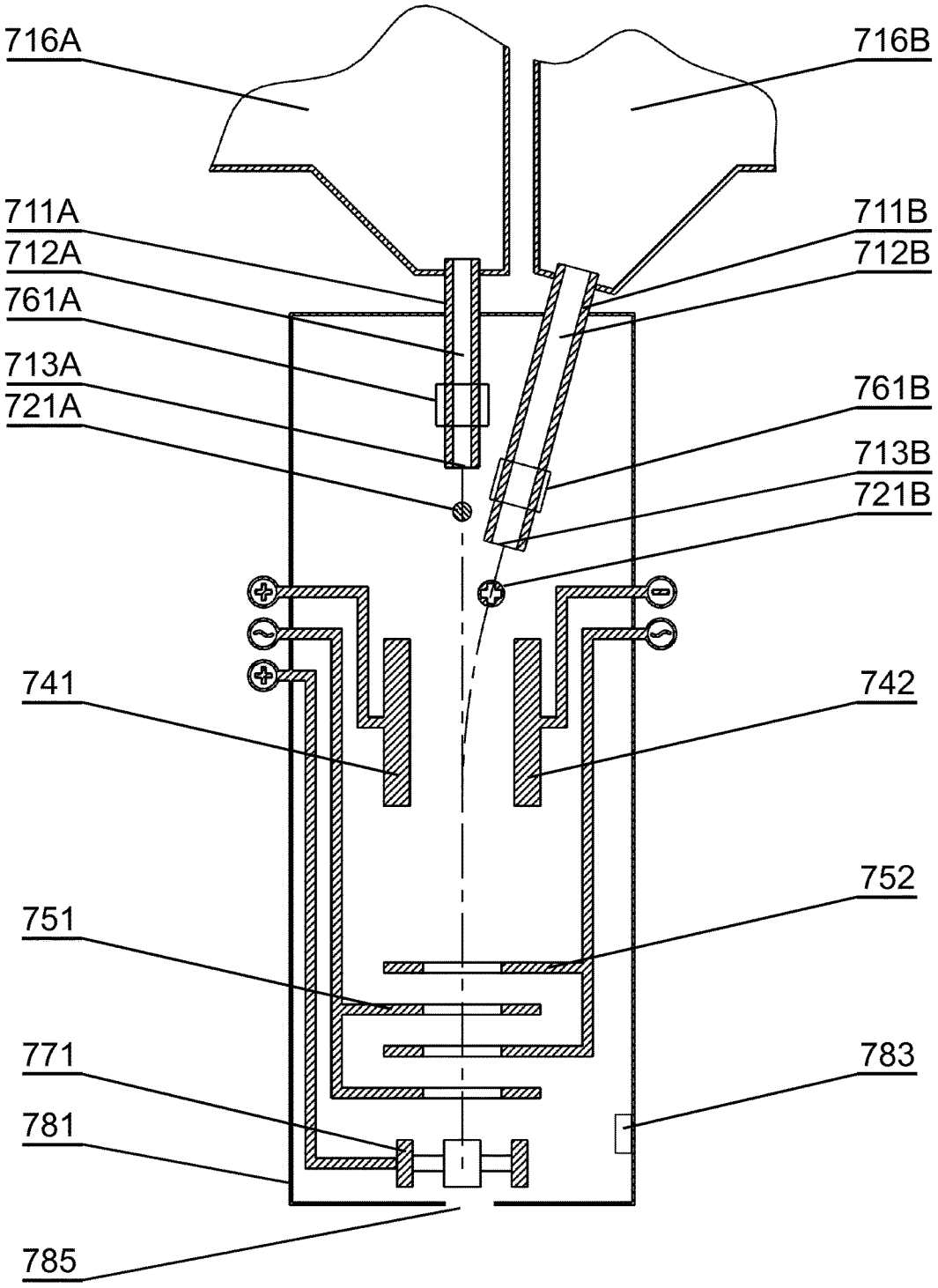
FIGS. 15A, 15B show schematically a nozzle assembly according to the seventh embodiment.
Figure 15B:
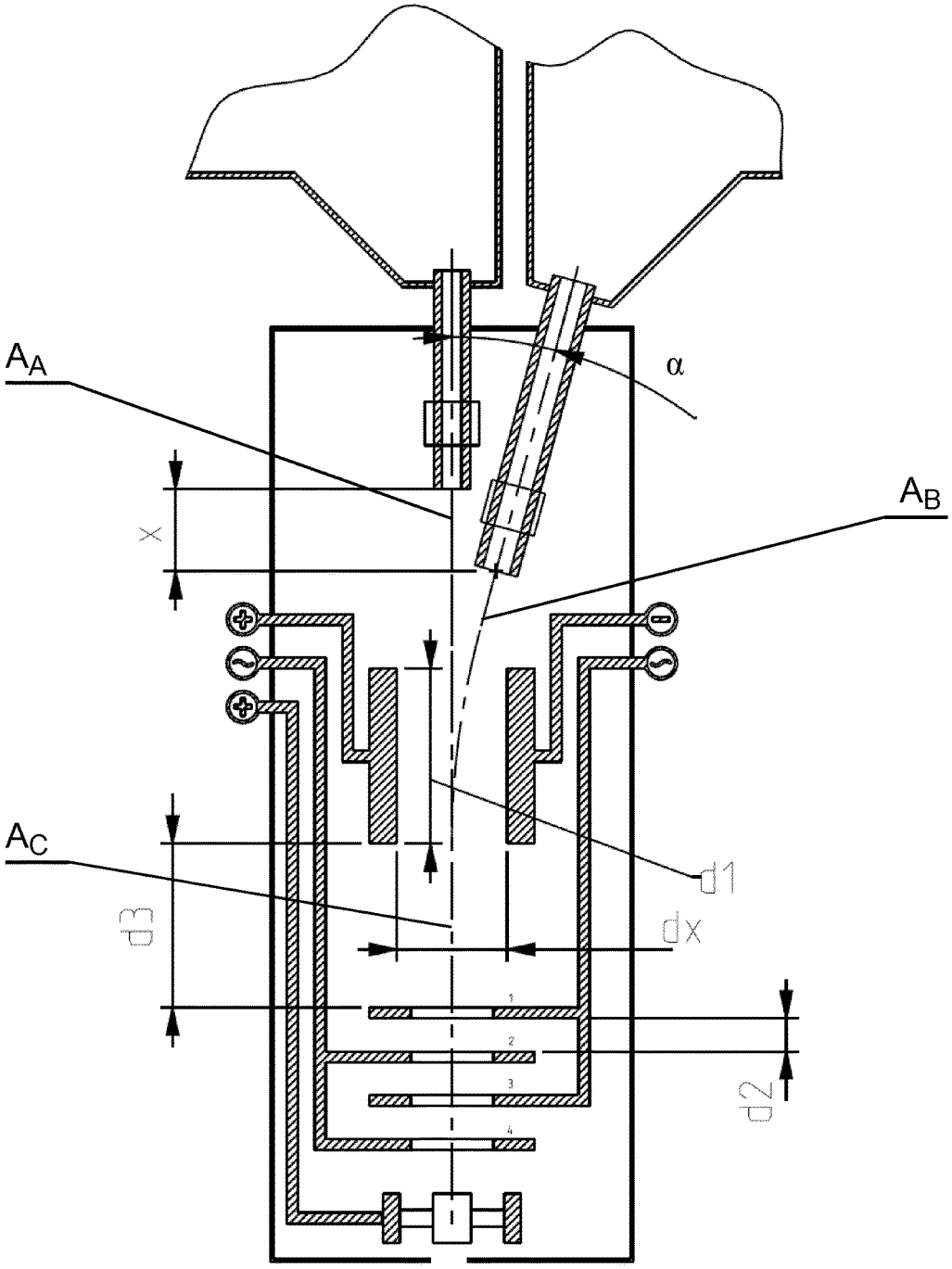

The inkjet printing head 700 according to a seventh embodiment is shown in a schematic overview in FIG. 14 and in a detailed cross-sectional view on FIGS. 15A and 15B, which show the same cross-sectional view, but for clarity of the drawing different elements have been referenced on different figures.

The inkjet printing head 700 may comprise one or more nozzle assemblies 710, each configured to produce a combined drop 722 formed of two primary drops 721A, 721B ejected from a pair of nozzles 711A, 711B. The printing head is of a drop-on-demand (DOD) type.

FIG. 14 shows a head with a plurality of nozzle assemblies 710 arranged in parallel to print multi-dot rows 791 on a substrate 790. It is worth noting that the printing head in alternative embodiments may comprise only a single nozzle assembly 710 or more nozzle assemblies, even as much as 256 nozzle assemblies or more for higher-resolution print.

Each nozzle 711A, 711B of the pair of nozzles in the nozzle assembly 710 has a channel 712A, 712B for conducting liquid from a reservoir 716A, 716B. At the nozzle outlet 713A, 713B the liquid is formed into primary drops 721A, 721B and ejected as a result of operation of drop generating and propelling devices 761A, 761B shown in a more detailed manner on FIGS. 10, 11, 12. The drop generating and propelling devices may be for instance of thermal (FIG. 10), piezoelectric (FIG. 11) or valve (FIG. 12) type. In case of the valve the liquid would need to be delivered at some pressure. One nozzle 711A is arranged preferably in parallel to the main axis $A_A$ of the printing head—for that reason, it will be called shortly a "parallel axis nozzle". The other nozzle 711B is arranged at an angle α to the first nozzle 711A—for that reason, it will be called shortly an "inclined axis nozzle". Therefore, the first nozzle 711A is configured to eject the first primary drop 721A to move along a first path and the second nozzle 711B is configured to eject the second primary drop 721B to move along a second path. The nozzle outlets 713A, 713B are distanced from each other by a distance equal to at least the size of the larger of the primary drops generated at the outlets 713A, 713B, so that the primary drops 721A, 721B do not touch each other when they are still at the nozzle outlets 713A, 713B. This prevents forming of a combined drop at the nozzle outlets 713A, 713B and subsequent clogging the outlets 713A, 713B with a solidified ink. Preferably, the angle α is a narrow angle, preferably from 3 to 60 degrees, and more preferably from 5 to 25 degrees (which aids in alignment the two drops before coalescence). In such a case, the outlet 713A of the parallel axis nozzle 711A is distanced from the outlet of the printing head by a distance larger by "x" than the outlet 713B of the inclined axis nozzle 711B.

The liquid produced by combination of drops from the two reservoirs 716A, 716B is a product of a chemical reaction of a first liquid supplied from a first reservoir 716A and a second liquid supplied from the second reservoir 716B (preferably a reactive ink composed of an ink base and a catalyst for initiating curing of the ink base). The ink base may be composed of polymerizable monomers or polymer resins with rheology modifiers and colorant. The catalyst (which may be also called a curing agent) may be a cross-linking reagent in the case of polymer resins or polymerization catalyst in the case of polymerizable resins. The nature of the ink base and the curing agent is such that immediately after mixing at the connection point 732 a chemical reaction starts to occur leading to solidification of the mixture on the printed material surface, so that the ink may adhere more easily to the printed surface and/or cure more quickly at the printed surface.

For example, the ink may comprise acrylic acid ester (from 50 to 80 parts by weight), acrylic acid (from 5 to 15 parts by weight), pigment (from 3 to 40 parts by weight), surfactant (from 0 to 5 parts by weight), glycerin (from 0 to 5 parts by weight), viscosity modifier (from 0 to 5 parts by weight). The catalyst may comprise azaridine based curing agent (from 30 to 50 parts by weight), pigment (from 3 to 40 parts by weight), surfactant (from 0 to 5 parts by weight), glycerin (from 0 to 5 parts by weight), viscosity modifier (from 0 to 5 parts by weight), solvent (from 0 to 30 parts by weight). The liquids may have a viscosity from 1 to 30 mPas and surface tension from 20-50 mN/m. Other inks and catalysts known from the prior art can be used as well. Preferably, the solvent amounts to a maximum of 10%, preferably a maximum of 5% by weight of the combined drop. This allows to significantly decrease the content of the solvent in the printing process, which makes the technology according to the invention more environmentally-friendly than the current CIJ technologies, where the content of solvents usually exceeds 50% of the total mass of the drop during printing process. For this reason, the present invention is considered to be a green technology.

The liquids supplied by the two reservoirs 716A, 716B can be various substances, selected such that immediately after mixing a chemical reaction leading to transformation of the first and second liquid to a reaction product starts to occur. Thus chemical reaction transforming the first and second liquid into a reaction product is initiated within the reaction chamber within the printing head. Therefore, a chemical reaction is initiated before the combined drop leaves the printing head enclosure and reaches the printed material surface.

Typically, the ink drop will be larger than the catalyst drop. In case the drops have different sizes, the smaller drop 721A is preferably ejected from the parallel axis nozzle 711A, while the larger drop 721B is preferably ejected from the inclined axis nozzle 711B, because it can accumulate higher electric charge and therefore it may be easier to control its path of movement. Preferably, the smaller drop 721A is ejected with a speed greater than the larger drop 721B.

The primary drops are preferably combined within the head 700, i.e. before the drops leave the outlet 785 of the head. The process of generation of primary drops 721A, 721B is controlled (by controlling their parameters, such as ejection time, force, temperature, etc) such that their path of movement can be predicted and arranged such that the primary drops combine to form a combined drop at a connection point 732.

The process of generation of primary drops 721A, 721B is controlled by a controller of the drop generating and propelling devices 761A, 761B (not shown in the drawing for clarity), which generates trigger signals. The primary drops are therefore generated on demand, in contrast to CIJ technology where a continuous stream of drops is generated at nozzle outlets. Each of the generated primary drops is then directed to the surface to be printed, in contrast to CIJ technology where only a portion of the drops is output and the other drops are fed back to a gutter.

In one embodiment, the head may be designed such that both drops 721A, 721B are ejected from the nozzle outlets 713A, 713B at the same time, i.e. the drop generating and propelling devices 761A, 761B can be triggered by a common signal.

In order to improve control over the coalescence process of two primary drops so that they integrate into one combined drop in a predictable and repeatable manner and also such as to achieve a predictable direction of flow of the combined drop 722, the paths of flow of the primary drops 721A, 721B are arranged to be in line with each other before or at the connection point 732. The primary drops are further configured to have different speeds before they reach the connection point 732, so that they may collide at the connection point 732. When two primary drops flowing with different speeds along the same axes collide, their coalescence is highly predictable and the combined drop will continue to flow along the same axis $A_C$.

The different speeds can be achieved by ejecting the primary drops from the nozzle outlets with different speeds. However in some embodiments it may be possible to eject the primary drops with substantially the same speed from both nozzle outlets. The fact that nozzles are arranged at an angle assures that the parallel component of velocity of the inclined drop will be smaller than the velocity of the parallel drop, while the speeds will change during the flow between the nozzle outlet and the connection point, e.g. due to flow resistance (e.g. related to drop size) or electrical field, etc.

The primary drop 721B output from the inclined axis nozzle outlet 713B has a non-zero electric charge and for that reason it will be called a charged primary drop 721B. The drop 721B may be charged in different ways. For example, the liquid in the reservoir 716B may be pre-charged. Alternatively, the liquid may be charged by charging electrodes located along the nozzle channel 712B or at the nozzle outlet 713B. Furthermore, the primary drop 721B may be charged after it is formed and/or ejected, along its path of movement, by charging electrodes located before the deflecting electrodes 741, 742.

A set of deflecting electrodes 741, 742 forming a capacitor is arranged along the path of flow of the charged primary drop 721B to alter the path of flight of the charged primary drop 721B, such as to align it in line with the path of flight of the primary drop 721A output from the other nozzle outlet 713A before or at the connection point 732. The electrodes 741, 742 are connected to controllable DC voltage sources and controllable according to known methods. Therefore, the path of flight of the charged primary drop 721B is affected over a distance $d_1$ of the range of operation of the electrodes. The distance $d_x$ between the electrodes is designed such as to avoid breakdown voltage of the capacitor or any physical contact between the flying drop and the electrodes, yet allowing generation the electric field strong enough to change the path of movement of the charged primary drop 721B from an inclined to a parallel path.

In another embodiment, the electrodes 741 and 742 can be a part of one cylindrical electrode with the same charge as the charged primary drop 721B. The distance $d_x$ will not be dependent on the capacitor breakdown voltage, as in the previous embodiment. Such embodiment will allow for higher tolerances of nozzle placement as well as enable parallel nozzle alignment. While it is less preferable from the point of view of stability of operations, it would require less precision of manufacturing.

It is also possible to align the nozzles 711A, 711B in parallel to each other and use a first set of electrodes to change the path of the charged drop 721B from parallel to inclined and a second set of electrodes to align the charged drop 721B with the parallel drop before the connection point 732.

Figure 17:
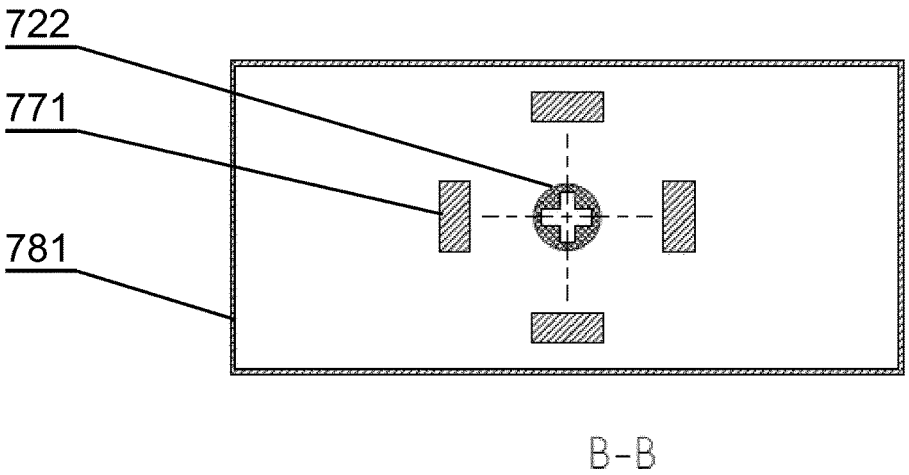
FIG. 17 shows schematically a set of electrodes for deflecting or correcting the path of drop movement at the output of the printing head in the seventh embodiment.

It is also possible to combine both previous embodiments: to use a first stage of deflecting electrodes (to align drops in parallel to each other) 741, 742 as shown on FIG. 15A, followed by electrodes similar to set of electrodes 771 presented at FIGS. 15A and 17 to more precisely guide the charged drop (or charged drops), which would increase the accuracy and stability of the path of drop movement prior to connection point 732 in order to further improve coalescence conditions.

Therefore, the deflecting electrodes 741, 742 function as means for controlling the flight of the first primary drop 721A and the second primary drop 721B to allow the first primary drop 721A to combine with the second primary drop 721B at the connection point 732 into the combined drop 722.

The parallel axis primary drop 721A has preferably a zero electrical charge, i.e. it is not charged.

However, other embodiments are possible, wherein the other primary drop 721A is also charged and ejected at an axis inclined with respect to the desired axis $A_C$ of flow of the combined drop 722, and the printing head further comprises another deflecting electrodes assembly for aligning its axis of flow to axis $A_C$ before the connection point 732.

In yet another embodiment, more than two primary drops may be generated, i.e. the combined drop 722 may be formed by coalescence (simultaneous or sequential) of more than two drops, e.g. three drops ejected from three nozzles, of which at least two have their axes inclined with respect to the desired axis of flow $A_C$ of the combined drop 722.

The axis of flow $A_C$ of the combined drop 722 is preferably the main axis of the printing head, but it can be another axis as well. The printing head may comprise additional means for improving drop placement control.

For example, the printing head may comprise a set of comb-like electrodes 751, 752 connected to controllable DC or AC voltage sources, configured to increase the speed of flow of the charged combined drop 722 before it exits the printing head outlet 785. The speed can be increased in a controllable manner by controlling the AC voltage sources connected to the electrodes 751, 752, in order to achieve a desired combined drop 722 outlet speed, to e.g. control the printing distance, which can be particularly useful when printing on uneven substrates. The set of accelerating electrodes 751, 752 should be placed at a distance $d_3$ from the deflecting electrodes 741, 742 which is large enough so that the electric fields generated by the electrodes do not interfere their operation in undesired manner. The distance $d_2$ and the number of accelerating electrode pairs where the combined drop 722 remains under the influence of accelerating force depends on the size of the combined drop 722 and the required increase of its speed. For some industrial printing applications the whole set of AC capacitors might be needed in order to preferably double or triple the combined drop speed, for example from 3 m/s to 9 m/s measured at the outlet 785 of the head. It is also possible to mount the DC electrodes as an accelerating unit. For office printer applications, no acceleration might be required.

Use of accelerating electrodes allows to eject primary drops from nozzle outlets with relatively small velocities, which helps in the coalescence (which occurs at certain optimal collision parameters depending on: relative speed of drops, their given surface tension, size, temperature etc.), and then to accelerate the combined drop in order to achieve desired printing conditions.

Furthermore, the printing head may comprise a set of electrodes 771 for deflecting or correcting (the path of drop movement) connected to a controllable DC voltage source, shown in a cross-section along line B-B of FIG. 15A in FIG. 17, which may controllably deflect the direction of the flow of the charged combined drop 722 in a desired direction to control drop placement in a manner equivalent to that known from CIJ technology or—in case of correcting electrodes—improve the alignment of the path of movement of the combined drop 722 parallel to the axis of head in order to improve drop placement accuracy.

Furthermore, the printing head may comprise means for speeding up the curing of the combined drop 722 before it leaves the printing head, e.g. a UV light source (not shown in the drawing) for affecting a UV-sensitive curing agent in the combined drop 722.

Therefore, the drop generation process is conducted as shown in details in FIGS. 16A-16E. First, primary drops 721A, 721B are ejected from nozzle outlets 713A, 713B as shown in FIG. 16A. The path of flow of the inclined axis drop 721B is altered to bring in into alignment with the path of flow of the parallel axis drop 721A, as shown in FIG. 16B. Once the primary drops 721A, 721B are on aligned paths, they move with different speeds as shown in FIG. 16C and eventually collide at a connection point 732 to form a combined drop 722, as shown in FIG. 16D. The combined drop may thereafter be further accelerated and/or deflected by additional drop control means and finally ejected as shown in FIG. 16E.

The liquids in the reservoirs 716A, 716B may be preheated or the nozzle outlets can be heated by heaters installed at the nozzle outlets, such that the ejected primary drops have an increased temperature. The increased temperature of working fluids (i.e. ink and catalyst) may lead to improved coalescence process of primary drops and preferably increase adhesion and decrease the curing time of the combined drop 722 when applied on the substrate having a temperature lower than the temperature of the combined drop. The temperature of the ejected primary drops should therefore be higher than the temperature of the surface to be printed, wherein the temperature difference should be adjusted to particular working fluid properties. The rapid cooling of the coalesced drop after placement on the printing surface (having a temperature lower than the ink) increases the viscosity of the drop preventing drop flow due to gravitation.

The printing head further comprises a cover 781 which protects the head components, in particular the nozzle outlets 713A, 713B and the area around the connection point 732, from the environment, for example prevents them from touching by the user or the printed substrate. The cover 781 forms the reaction chamber. Because the connection point 732 is within the reaction chamber, the process of combining primary drops can be precisely and predictably controlled, as the process occurs in an environment separated from the surrounding of the printing head. The environment within the printing head is controllable and the environment conditions (such as the air flow paths, pressure, temperature) are known and therefore the coalescence process can occur in a predictable manner.

Moreover, the cover 781 may comprise heating elements (not shown in the drawing) for heating the volume within the cover 781, i.e. the volume surrounding of the nozzle outlets 713A, 713B and liquid reservoirs 716A, 766B to a predetermined temperature elevated in respect to the ambient temperature, for example from 40° C. to 80° C. (other temperatures are possible as well, depending on the parameters of the drops), such as to provide stable conditions for combining of the drops. A temperature sensor 783 may be positioned within the cover 781 to sense the temperature. The higher temperature within the printing head facilitates better mixing of coalesced drop by means of diffusion. Additionally, the increased temperature increases the speed of chemical reaction starting at the moment of mixing. Ink reacting on the surface of printed material allows for better adhesion of the printed image.

Moreover, the printing head 710 may comprise gas-supplying nozzles (not shown in the drawing) for blowing gas (such as air or nitrogen), preferably heated, along the axes $A_A$, $A_B$ and/or $A_C$, in order to decrease the curing time, increase the dynamics of movement of the drops and to blow away any residuals that could be formed at the nozzles outlets 713A, 713B or other components of the nozzle assembly.

Therefore, that embodiment can be used in drop on demand printing method to discharge the first primary drop 721A of the first liquid to move along the first path and to discharge the second primary drop 721B of the second liquid to move along the second path; and to control, by means of the separator, the flight of the first primary drop 721A and the second primary drop 721B to combine the first primary drop 721A with the second primary drop 721B at the connection point 732 within the reaction chamber 781 within the printing head so that a chemical reaction is initiated within a controlled environment of the reaction chamber 781 between the first liquid of the first primary drop 721A and the second liquid of the second primary drop 721B.

This embodiment uniquely combines the features and advantages of two well known ink jet technologies by means of delivering the working drop ink in the way DOD printers work—including high resolution ones—but being able to deflect and control its flight path in the way CIJ printers work, with the drying or curing time of the imprint also closer to CIJ standards. Such invention improves technical possibilities to apply high quality durable digital imprints on vast variety of substrates and products. This feature will prove to be especially advantageous in majority of industrial marking and coding applications.

Eighth Embodiment

Figure 18:
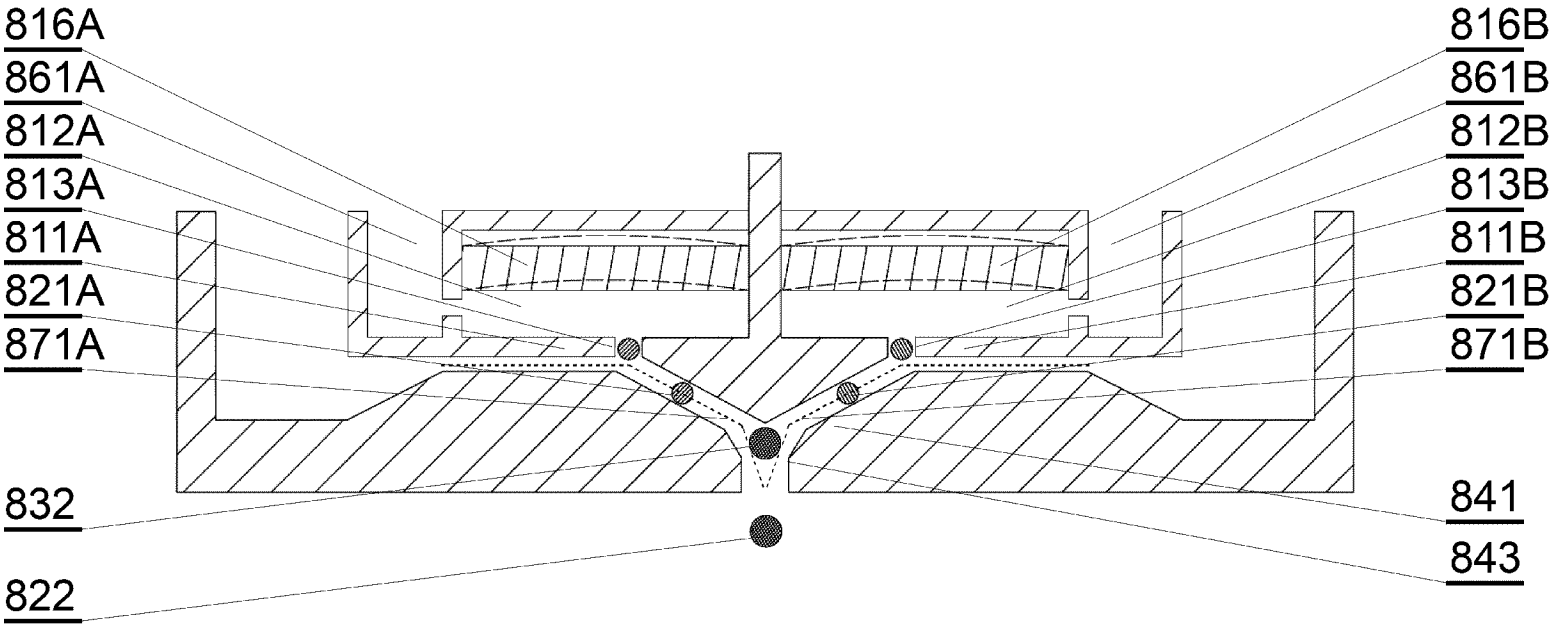
FIG. 18 shows schematically a printing head according to an eighth embodiment.

The eighth embodiment of the head 800 is shown in an overview in FIG. 18. The eighth embodiment 800 is adapted particularly for use with large-size drop generating and propelling devices.

The primary drops 821A, 821B are ejected from the nozzle outlets 813A, 813B of nozzles 811A, 811B which preferably have at least the end sections of their channels 812A, 812B arranged substantially perpendicularly to the main axis X of the printing head. The nozzle channels 812A, 812B may accommodate large-size (e.g. piezoelectric) drop generating and propelling devices 861A, 861B. The primary drops 821A, 821B are formed of a first liquid and second liquid from the reservoirs 816A, 816B.

The primary drops 821A, 8211B are ejected to move along respectively the first and second path, which are initially arranged substantially in parallel to the main axis X. The primary drops 821A, 821B are then guided within a primary enclosure 841 (which functions as the reaction chamber) by streams of gas 871A, 871B which may be generated within the primary enclosure 841. The primary enclosure 841 has a downstream-narrowing cross section. The outlet section 843 of the primary enclosure 841 has preferably a constant, round cross-section of a diameter at least slightly larger (e.g. at least 110% or at least 150% or at least two times larger) than the desired diameter of the combined drop 822, and may be further configured such as described with respect to the section 243 of the second embodiment as shown in FIGS. 4A-4B.

Therefore, that embodiment can be used in drop on demand printing method to discharge the first primary drop 821A of the first liquid to move along the first path and to discharge the second primary drop 821B of the second liquid to move along the second path; and to control, by means of the shape of the channel of primary enclosure 841 and streams of gas, the flight of the first primary drop 821A and the second primary drop 821B to combine the first primary drop 821A with the second primary drop 821B at the connection point 832 within the reaction chamber 841 within the printing head so that a chemical reaction is initiated within a controlled environment of the reaction chamber 841 between the first liquid of the first primary drop 821A and the second liquid of the second primary drop 821B.

Further Embodiments

It shall be noted that the drawings are schematic and not in scale and are used only to illustrate the embodiments for better understanding of the principles of operation.

The present invention is particularly applicable for high resolution DOD inkjet printers. However, the present invention can be also applied to low resolution DOD based on valves allowing to discharge drops of pressurized ink.

The environment in the reaction chamber may be controlled by controlling at least one of the following parameters: chamber temperature (e.g. by means of a heater within the reaction chamber), velocity of the streams of gas (e.g. by controlling the pressure of gas delivered), gas components (e.g. by controlling the composition of gas delivered from various sources), electric field (e.g. by controlling the electrodes), ultrasound field (e.g. by providing additional ultrasound generators within the reaction chamber, not shown in the drawings), UV light (e.g. by providing additional UV light generators within the reaction chamber, not shown in the drawings), etc.

A skilled person will realize that the features of the embodiments described above can be further mixed between the embodiments. For example there can be more than two nozzles directing more than two primary drops in order to form one combined drop by means of using the same principles of discharging, guiding, forming, also by means of controlled coalescence, and accelerating drops within the print head as described above.

The invention claimed is:

1. A printing method, including combining a first primary drop and a second primary drop to form a combined drop, by performing a method, comprising:

discharging the first primary drop of a first liquid collected from a first liquid reservoir to move along a first path;

discharging the second primary drop of a second liquid collected from a second liquid reservoir to move along a second path;

controlling flight of the first primary drop and the second primary drop to combine the first primary drop with the second primary drop into the combined drop at a connection point within a reaction chamber within a printing head so that a chemical reaction is initiated within a controlled environment of the reaction chamber between the first liquid of the first primary drop and the second liquid of the second primary drop; and controlling flight of the combined drop through the reaction chamber along a combined drop path directed towards a surface to be printed upon such that the combined drop, during movement along the combined drop path starting from the connection point, is distanced from one or more elements of the printing head.

2. The method according to claim 1, further comprising preventing the first and second primary drops from contacting each other at nozzle outlets by providing a separator between ending portions of a plane of the nozzle outlets.

3. The method according to claim 2, further comprising controlling flight of the first primary drop and the second primary drop by the separator to guide the first primary drop and the second primary drop.

4. The method according to claim 1, wherein a length of a side wall of a separator, from a plane of a nozzle outlet ending, is not shorter than the diameter of the primary drop.

5. The method according to claim 1, further comprising controlling a path of flight of the first primary drop and the second primary drop at a distance not shorter than 50% of the distance between a nozzle outlet and the connection point.

6. The method according to claim 1, further comprising controlling a path of flight of the first primary drop and the second primary drop by an electric field.

7. The method according to claim 1, further comprising controlling at least one of the following parameters within the reaction chamber: chamber temperature, electric field, ultrasound field, and UV light.

8. A printing head comprising:

a nozzle assembly comprising:

a first nozzle connected through a first channel with a first liquid reservoir with a first liquid and having a first drop generating and propelling device for forming on demand a first primary drop of the first liquid and discharging the first primary drop to move along a first path; and a second nozzle connected through a second channel with a second liquid reservoir with a second liquid and having a second drop generating and propelling device for forming on demand a second primary drop of the second liquid and discharging the second primary drop to move along a second path;

a reaction chamber, the first path crosses with the second path within the reaction chamber at a connection point; and means for controlling flight of the first primary drop and the second primary drop and configured to allow the first primary drop to combine with the second primary drop at the connection point to form a combined drop so that a chemical reaction is initiated within a controlled environment of the reaction chamber between the first liquid of the first primary drop and the second liquid of the second primary drop during flow of the combined drop through the reaction chamber along a combined drop path, wherein the combined drop, during movement along the combined drop path starting from the connection point, is distanced from elements of the printing head.

9. The printing head according to claim 8, further comprising means for controlling flight of the combined drop along the combined drop path.

10. The printing head according to claim 8, wherein the means for controlling the flight of the first primary drop and the second primary drop is a separator having a downstream-narrowing cross-section positioned between nozzle outlets.

11. The printing head according to claim 10, wherein the separator is configured to guide the primary drops along its side walls and to separate ending portions of a plane of the nozzle outlets.

12. The printing head according to claim 8, wherein the means for controlling the flight of the first primary drop and the second primary drop comprises a set of electrodes for altering a path of flight of the second primary drop to a path of flight being in line with a path of flight of the first primary drop before or at the connection point.

13. The printing head according to claim 8, wherein either the second primary drop is a charged drop having a non-zero electric charge or the liquid in the second reservoir connected with the second nozzle is charged.

14. The printing head according to claim 8, further comprising a set of electrodes connected to a controllable DC voltage source and located downstream with respect to the connection point to either deflect and to correct a path of flight of the combined drop or to deflect or correct the path of flight of the combined drop.

15. The printing head according to claim 8, wherein the first liquid is an ink base and the second liquid comprises a catalyst for curing the ink base.

* * * * *